US006678589B2

(12) United States Patent
Robertson et al.

(10) Patent No.: US 6,678,589 B2
(45) Date of Patent: Jan. 13, 2004

(54) BOAT POSITIONING AND ANCHORING SYSTEM

(75) Inventors: Glen E. Robertson, 1304 S. Orange Ave., Sarasota, FL (US) 34239; John Webster, Huntsville, AL (US)

(73) Assignee: Glen E. Robertson, Sarasota, FL (US)

( * ) Notice: Subject to any disclaimer, the term of this patent is extended or adjusted under 35 U.S.C. 154(b) by 0 days.

(21) Appl. No.: 10/118,400

(22) Filed: Apr. 8, 2002

(65) Prior Publication Data

US 2003/0191562 A1 Oct. 9, 2003

(51) Int. Cl.[7] ..... G06F 15/50; B63H 21/22

(52) U.S. Cl. ..... 701/21; 701/116; 701/205; 701/224; 114/246

(58) Field of Search ..... 701/21, 116, 205, 701/224; 114/259, 145 A, 293, 246; 342/176; 440/1, 2, 84

(56) References Cited

U.S. PATENT DOCUMENTS

| | | | | |
|---|---|---|---|---|
| 4,225,286 A | | 9/1980 | Fork | |
| 4,752,258 A | | 6/1988 | Hochleitner et al. | |
| 5,041,029 A | * | 8/1991 | Kulpa | 440/1 |
| 5,179,385 A | * | 1/1993 | O'Loughlin et al. | 342/176 |
| 5,202,835 A | | 4/1993 | Knight | |
| 5,386,368 A | | 1/1995 | Knight | |
| 5,491,636 A | | 2/1996 | Robertson et al. | |
| 5,523,951 A | | 6/1996 | Kriesgman et al. | |
| 5,525,081 A | | 6/1996 | Mardesich et al. | |
| 5,576,716 A | | 11/1996 | Sadler | |
| 5,588,798 A | | 12/1996 | Fork | |
| 5,777,578 A | | 7/1998 | Chang et al. | |
| 5,832,440 A | | 11/1998 | Woodbridge et al. | |
| 5,884,213 A | | 3/1999 | Carlson | |
| 5,931,110 A | | 8/1999 | Yamamoto | |
| 6,072,430 A | | 6/2000 | Wyrwas et al. | |
| 6,125,782 A | | 10/2000 | Takashima et al. | |
| 6,273,771 B1 | * | 8/2001 | Buckley et al. | 440/84 |
| 6,276,975 B1 | * | 8/2001 | Knight | 440/2 |

* cited by examiner

*Primary Examiner*—Thomas G. Black
*Assistant Examiner*—Tuan C To
(74) *Attorney, Agent, or Firm*—Charles J. Prescott

(57) ABSTRACT

An anchorless boat positioning system for establishing and maintaining a boat at a selected geographic location without the use of a conventional anchor. In one embodiment, a steerable thruster is used whose thrust and steering direction are determined and controlled on the basis of position information signals received from global positioning system (GPS) satellites, relative steering angle between the boat and the thruster and boat heading indication signals from a magnetic compass. The system continuously monitors the position and heading of the boat and compares it with the stored coordinates of the selected anchoring location(s) to generate control signals for the steerable motor. Several modes of operation are disclosed and Euler transformations for offset antenna placement for error reduction are taught. Proportional, integral, and derivative control (PID) of four constants of vessel control is also provided. Multiple thrusters in various arrangements are also provided to control either the orientation of the boat or a second point of interest on the boat at a second geographic location.

39 Claims, 11 Drawing Sheets

YAW RATE DAMPENING

TUNNEL THRUSTER AND STERN PROPULSION

ANCHOR MODE WITH 2 POINTS BEING ANCHORED

BOAT POSITIONING AND ANCHORING SYSTEM

BACKGROUND OF THE INVENTION

1. Scope of Invention

This invention relates to an anchorless boat positioning system and more particularly to a multi-mode system for accurately approaching and maintaining a pre-selected location of a floating vessel without the use of a physical anchor.

2. Prior Art

Boat anchors have been used for thousands of years. The anchor is attached to the boat with a line or "rode" and then lowered overboard so that the flukes and/or shear weight of the anchor dig into the water bottom. Problems exist, however, in using anchors in certain settings. The depth of the water may prohibit anchoring because the length of the line needed to reach the water bottom with proper scope is impractical.

Moreover, even if the anchor reaches the water bottom, the depth of the water may be so great that it becomes difficult to maintain the anchored boat within close proximity to a desired position when varying wind or water currents are present. The line from the boat to the anchor acts as a tether allowing the boat, subject to the current and wind, to swing about an arc whose radius is nearly that of the length of the anchor line.

In small watercraft, manually lowering and raising a conventional anchor is also strenuous and time consuming, plus there is always the possibility of the anchor becoming fouled on the bottom, a common aggravation for the skipper.

Further, the use of anchors may be restricted in waters where, for example, underwater cabling has been installed (usually indicated on navigational charts) or where a salvage operation is taking place. The use of anchors which dig and plow has also come under criticism for causing severe damage to fragile underwater ecosystems. For example, anchors of fishing vessels have caused significant damage to long-standing coral reefs, resulting in these areas being designated as "No Anchoring" areas.

In U.S. Pat. No. 5,386,368, Knight teaches an apparatus for maintaining a floating boat or water vessel in a desired position. The apparatus includes an electric trolling motor disposed to produce a thrust to pull the boat, a steering motor disposed to affect the orientation of the electric trolling motor, a position deviation detection unit and a control circuit. The position deviation detection unit detects a deviation in the position of the boat from the desired position and transmits signals indicative of a deviation distance and a return heading to the control circuit. The control circuit causes the steering motor to steer the electric trolling motor in the return heading, and the electric trolling motor to propel the boat in the return heading to return the boat to the desired position. A first embodiment of the position deviation detection unit detects a deviation in position based on signals from a satellite-based global positions system. Another embodiment detects a deviation in position based on a signal from an anchored transmitter. A third embodiment detects a deviation in position based on the forces caused by the surrounding water when the boat drifts.

As disclosed in U.S. Pat. No. 5,491,636 by Robertson, et al, the invention allows a boat to be dynamically and automatically held in position at a selected anchoring location on the water without the use of a conventional anchor line, or winch by controlling the thrust and steering of a thruster (e.g., trolling motor) attached to the boat. The thruster is controlled on the basis of signals received from global positioning system (GPS) satellites orbiting the earth and a digital magnetic compass mounted on the thruster. The signals from the GPS satellites provide an ongoing indication of the position of the boat in earth positional coordinates while the compass provides continuous heading indications of the thruster. With this information, a controller compares the positional coordinates of the selected anchoring location with the positional coordinates of the boat's current location and generates steering and thrust signals to the thruster to move the boat to the anchoring site.

The global positioning system (GPS), available for use by both civilians and the military, is a multiple-satellite based radio positioning system, placed into orbit by The United States of America Department of Defense, in which each GPS satellite transmits data that allows a user to precisely measure the distance from selected ones of the GPS satellites to his antenna and to thereafter compute position, velocity, and time parameters to a high degree of accuracy, using known triangulation techniques. The signals provided by the GPS can be received worldwide twenty-four hours a day. The accuracy in determining the earth positional coordinates may be augmented through the use of a differential reference station for providing differential correction information (DGPS mode) to the receiver.

In one general aspect of the '636 patent, an anchorless boat positioning system for substantially maintaining the position of a boat at a desired location includes one or more thrusters attached to the boat for moving the boat to the selected location within the water, a GPS receiver receiving signals from GPS satellites for providing position information signals indicative of the position, of the boat, a magnetic compass for providing a heading indication signal representative of the direction the thruster is pointed, and a controller (e.g., computer) for providing control signals to control the magnitude and direction of the thrust on the basis of the position information signals from the GPS receiver and the heading indication signal from the magnetic compass.

Embodiments of the '636 patent included one or more of the following features. The control signals are based on the range, rate of change in range, and bearing from the present location of the boat to the selected anchoring location. A single thruster, fully rotatable about a vertical axis extending from above the surface of the water to below the surface of the water and transverse to the direction of propulsion of the thruster, is used to maintain the position of the boat. The control signals include thrust control signals for varying the amount of thrust generated by the thruster and steering control signals for controlling the direction that the thruster is pointing. The thruster is typically attached to the bow of the boat. The anchorless positioning system may include a GPS reference receiver positioned at a known location different from the position of the GPS receiver aboard the boat with the GPS receiver on board the boat receiving signals from both the GPS reference receiver and the GPS satellites to provide position information signals differential GPS mode, a technique for improving the accuracy in determining earth positional coordinates. The magnetic compass provides a heading indication signal representative of the heading of the thruster. The control signals relate to the difference between a present position and a selected location.

Optionally, a first non-rotatable thruster was used for providing thrust in a direction along a long axis of the boat and a second non-rotatable thruster for providing thrust in a direction transverse to that of the first non-rotatable thruster to maintain the heading of the boat toward the selected anchor location. The controller provides thrust control signals to the first non-rotatable thruster and steering control signals to the second non-rotatable thruster. An additional thruster may be positioned at the stern of the boat to assist in propelling the boat in the direction of the boat's heading.

In another aspect of the '636 patent, a method of substantially maintaining a position of a boat at a selected location in water included receiving and storing position information signals from GPS satellites with a GPS receiver to establish positional coordinates of a selected anchoring location: receiving, after a predetermined period of time, position information signals from the GPS satellites with the GPS receiver to determine a present location of the boat and a present heading indication of the thruster from the magnetic compass; and controlling the magnitude and direction of the thrust of at least one thruster on the basis of the difference between the positional coordinates of the anchoring location and the present location.

BRIEF SUMMARY OF THE INVENTION

This invention is directed to an anchorless boat or water vessel positioning system for maintaining a boat at a selected anchoring location within water without the use of a conventional anchor. A steerable thruster is used whose thrust and steering direction are determined and controlled on the basis of position information signals received from global positioning system (GPS) satellites and heading indication signals from a magnetic compass. The anchorless positioning system continuously monitors the position and heading of the boat and compares it with the stored coordinates of the selected anchoring location(s) to generate control signals for the steerable motor. Several modes of operation are disclosed and Euler transformations for offset antenna placement for error reduction are taught. Proportional, integral, and derivative control (PID) of three constants of vessel control is also provided.

It is therefore an object of this invention to provide a boat positioning and anchoring system which will accurately position and hold a floating vessel on a body of water in a preselected point on the water aided by GPS data.

It is yet another object of this invention to provide a multi-operational mode virtual anchor system which may also be used in trolling-type fishing and under manual operation through the use of a remote hand-held controller.

Still another object of this invention is to provide a boat positioning and anchoring system which operates under proportional, integral and derivative (PID) control for superior performance and capability in achieving and maintaining a desired anchor point of a floating vessel.

Yet another object of this boat positioning and anchoring system is to accommodate GPS antenna placement remote from the rotational axis of the thruster both horizontally and vertically.

In accordance with these and other objects which will become apparent hereinafter, the instant invention will now be described with reference to the accompanying drawings.

DETAILED DESCRIPTION OF THE INVENTION

Figure 1A:
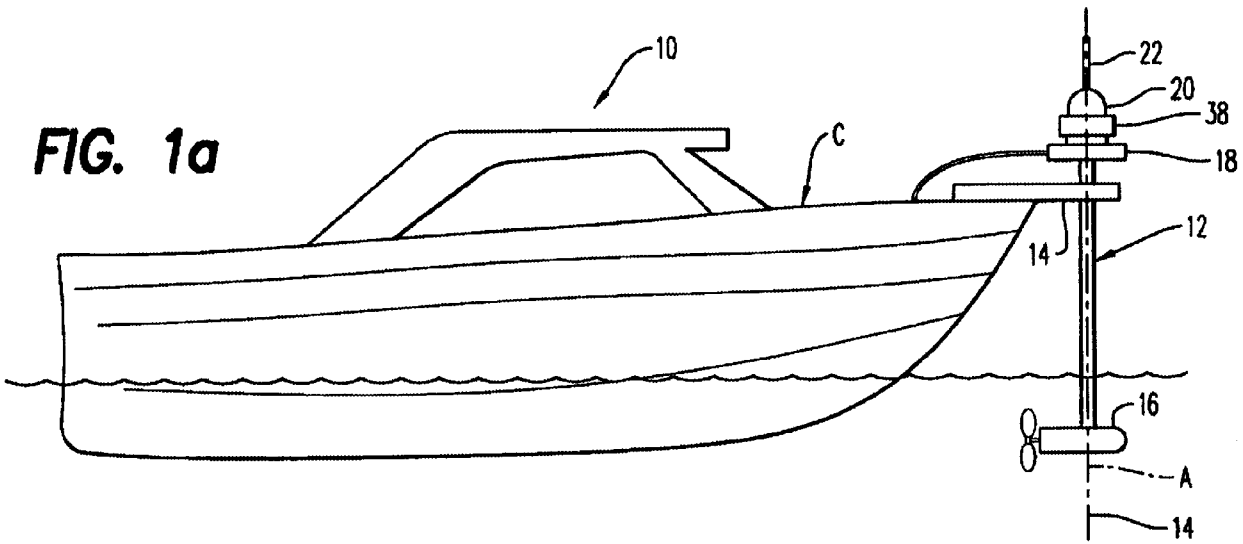
FIG. 1*a* is a diagrammatic view of a boat having a thruster positioning motor mounted to the bow of the boat.
Figure 2:
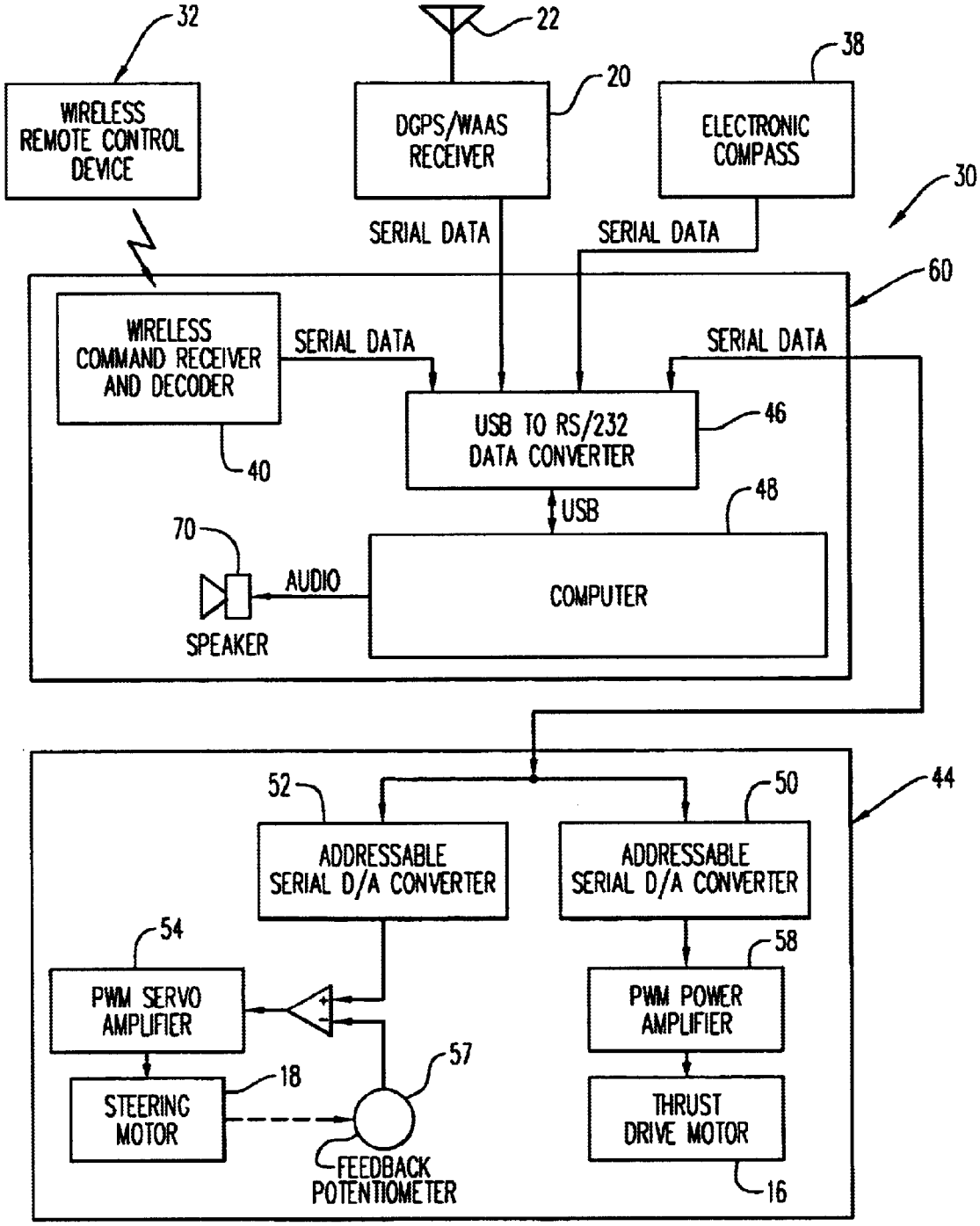
FIG. 2 is a block diagram showing the primary functions of the present invention.
Figure 3:
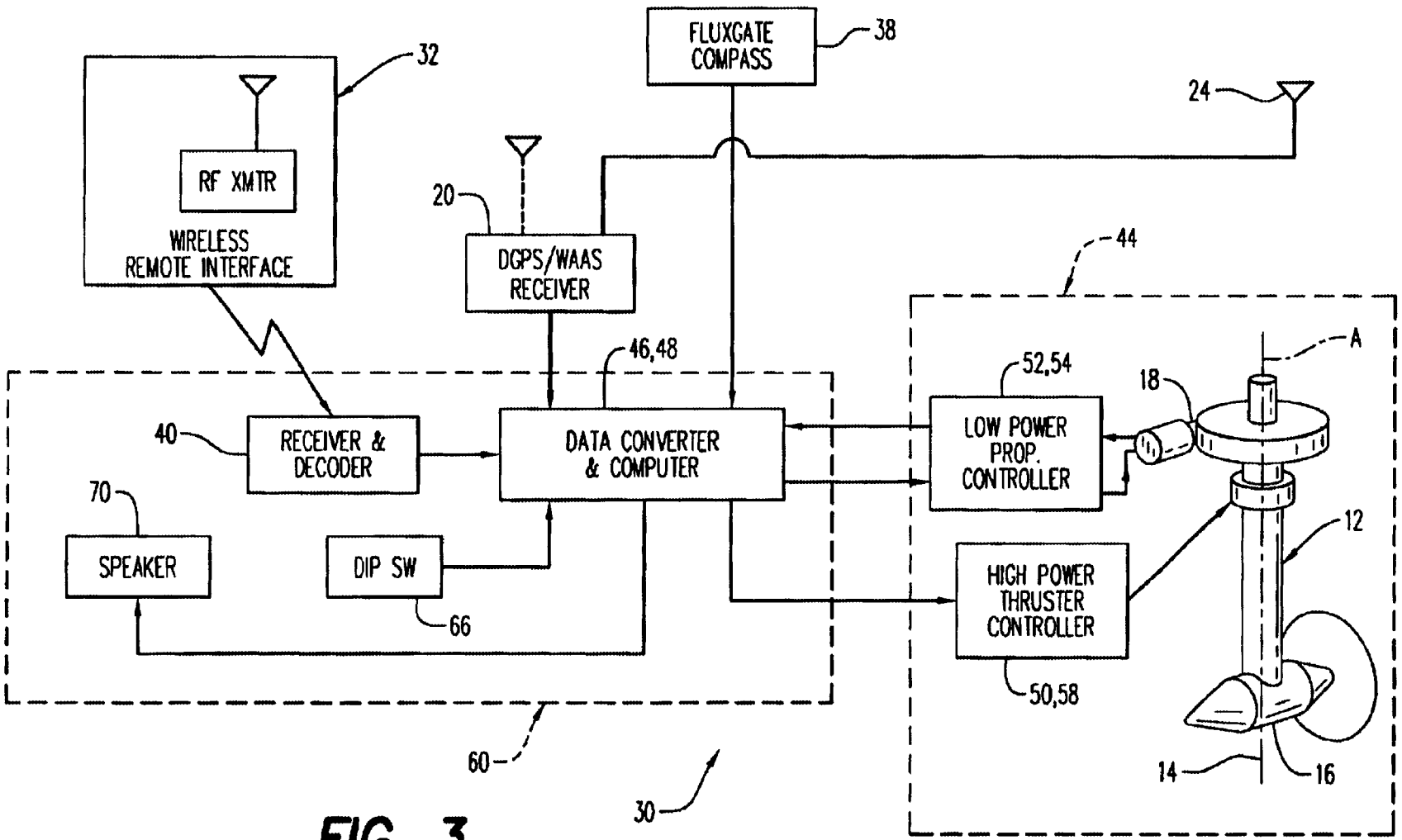
FIG. 3 is a block diagram illustrating the primary components of the anchorless boat positioning system.

Referring to the drawings, and first to FIG. 1*a*, a boat C is shown floating on a body of water. The boat C, including the positioning and anchoring system shown generally at numeral 30 in FIGS. 2 and 3, is shown generally at numeral 10 in FIG. 1*a* and at 10' in FIG. 1*b*. The boat C in FIG. 1*a* includes a thruster 12 mounted on bow support 14 about a vertical axis A. The thruster 12 is controlled in its rotational position about axis A by a steering servo 18 through an angle of ±about 1850 or in substantially all directions forward of the boat C. Disposed at the lower end of the thruster 12 is a drive unit 16 for propelling the boat C.

The Boat C in FIG. 1*b* also includes a stern propulsion unit 26 having a drive propeller 28 disposed about a horizontal axis below the surface of the water. The propulsion unit 26 is either made pivotable about a vertical axis B or may be held stationary as controlled by the steering system D of the boat C.

Figure 1B:
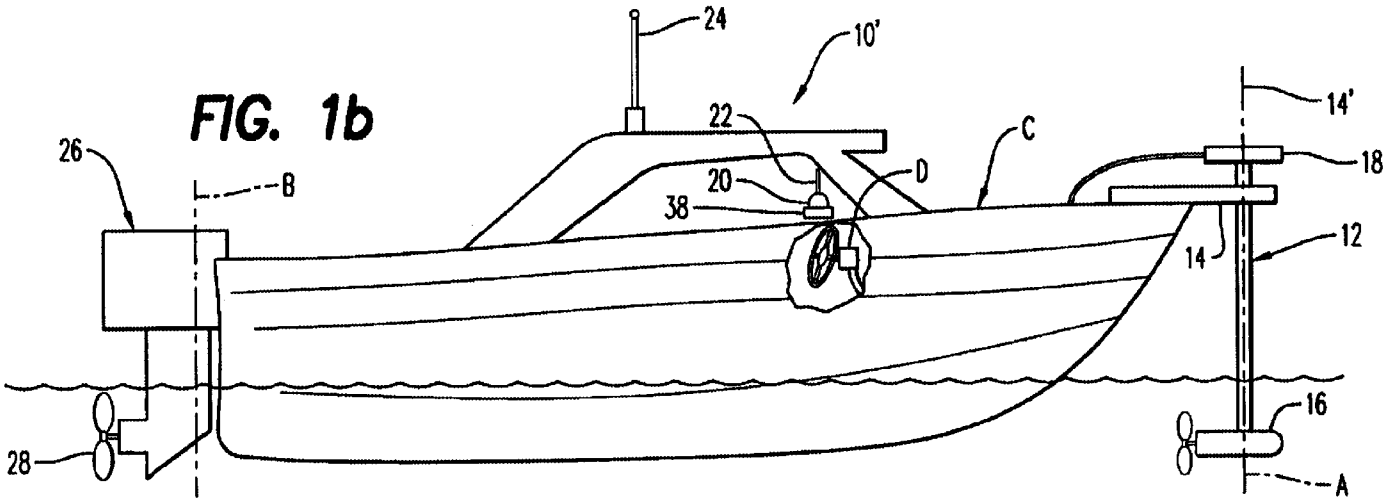
FIG. 1*b* is a diagrammatic view similar to FIG. 1*a* also including a rear thruster and a remote antenna placement.

Alternate system component placement is also depicted in FIGS. 1*a* and 1*b*. In FIG. 1*a*, the digital magnetic compass 38, the DGPS signal receiving unit 20 and the GPS antenna 22 are all coaxially aligned about upright axis A of thruster 12. In FIG. 1*b*, the magnetic compass 38 and GPS receiver are positioned in the cockpit, while the DGPS signal antenna 22 and beacon antenna 24 are placed atop the enclosure of the vessel 10' as shown.

In the present invention, the compass 38 is preferably mounted at a convenient place or position on the boat, rather than directly above the thruster 12. A potentiometer is included with the steering servo controller 18 (described in more detail herebelow) to measure the thruster steering angle with respect to the longitudinal axis of the boat. These two inputs of compass magnetic heading and thruster steering angle greatly improve the dynamic response of the thruster steering arrangement. In the previous '636 patent, the compass was defined as being mounted on the thruster.

Thus, the magnetic compass information tended to lag the actual heading of the thruster requiring a limitation on the speed of thruster steering angle response. The present system provides a thrust vector in the desired direction much faster to achieve better steering speed and accuracy. Because the boat turns more slowly than does the thruster, any effect of compass lag is minimized.

The operator of the boat C, when using the anchoring mode of the system 30 to maintain a favorable location 14 along axis A, effectively "anchors" the boat by pressing a button located on a separate wireless hand held remote interface 32 as shown in FIGS. 2 and 3. The system 30 determines the earth positional coordinates of the selected location from global positioning system signals received by a satellite global positioning system (GPS) antenna 20 and stores the coordinates. As the boat C begins to drift from location 14, the system 30 continuously receives positional information from receiver 20 (FIGS. 2 and 3) via antenna 22 or 24 and heading information from digital compass 38 to generate signals for controlling the thrust and direction of thruster 12 to maintain the bow of the boat at essentially location 14.

Thruster 12 is preferably mounted at the bow of boat 10 which generally has a more streamlined and contoured design for minimizing resistance as it moves through the water. Thus, when attached at the bow, with thruster axis A perpendicular to the water, the boat is more easily aligned with forces caused by changing currents and winds and can better deflect these disturbing forces. Moreover, the stern of the boat is left free for other activities (e.g., fishing, working or diving) by the operators and passengers. The alternate and preferred embodiment 10' in FIG. 1*b* shows that the GPS unit 20 and separate antenna 24 shown in FIG. 1*b* may be mounted at any convenient location, both aft and vertically of the bow as described more completely elsewhere herein.

Referring to the block diagrams of FIGS. 2 and 3, the anchorless positioning system 30 includes a differential global positioning satellite (DGPS) receiver 20 located aboard boat 10 for receiving, via antenna 22 or 24, course acquisition code (C/A-code) signals transmitted at a frequency of 1575.42 MHz from orbiting GPS satellites. C/A-code is also often referred to as civilian accuracy code to distinguish it from the longer P-code which provides higher position resolution but is restricted for use by the Department of Defense. Receiver 20 is a DGPS MAX receiver by CSI Wireless, Inc. in Calgary, Alberta, Canada. The navigation processing memory functions performed by the DGPS receiver 20 include satellite orbit calculations and satellite selection, atmospheric delay correction calculations, navigation solution compotation, clock bias and rate estimates, computation of output information and coordinate conversation of the position information.

The accuracy in calculating the position, time and velocity parameters by receiver 20 is significantly improved using differential GPS (DGPS) techniques. This technique involves the use of a DGPS reference station (not shown) operating at a surveyed location, generally onshore. The reference station includes a DGPS reference receiver which may be of the same type a receiver 20, for receiving signals from satellites and computing satellite pseudo range correction data using prior knowledge of the correct satellite pseudo ranges. The satellite pseudo range correction data is converted to radio frequency shift modulated signals with reference station modem and then broadcast to users within communication range in the same geographic area with a transmitter over a radio digital data link. The pseudo range corrections are received by the receiver 20 aboard boat 10 or 10' and demodulated with a radio as digital data link. These corrections are incorporated into the calculation of the navigation solution and to correct for the observed satellite pseudo range measurements, thereby improving the accuracy of the position determination to within 2–5 meters or better.

In the FAA Wide Area Augmentation System (WAAS), the corrected differential message is broadcast through one of two geostationary satellites, or satellites with a fixed position over the equator. The information is compatible with the basic GPS signal structure, which means any WAAS-enabled GPS receiver can read the signal. Better quality WAAS-enabled GPS receivers can achieve an accuracy within one meter.

The navigational correction messages are provided in standard National Marine Electronics Association (NMEA) format. Similarly, NMEA formatted signals from a digital flux gate compass 38 indicating the thrust motor's heading are provided over data line to a data converter 46 within a system controller 60. Digital compass 38 is made by E. S. Ritchie and Sons, Inc., of Pembrooke, Mass., model DH-0200 and includes the feature of automatically converting the magnetic heading to the true digital heading. A Universal Serial Bus (USB) data converter 46 passes the signals from DGPS receiver 20 and compass 38 to a computer 48, an IBM PC compatible embedded computer having a USB port. Note that the positional and heading signals from DGPS receiver 20 and compass 38, respectively, may be provided directly to computer 48; however, passing the positional and heading signals through USB data converter 46 simplifies the wiring between the components when they are remotely located. Note also that the boat heading could also be determined with GPS technology by utilizing an array of GPS antennas and four GPS receivers combined to computer azimuth, pitch and roll as well as geographic location. This more complex method would eliminate the need for an electronic magnetic compass.

Computer 48 compares the position of the boat to that of the anchor site to calculate range and bearing data for moving the boat toward the desired anchoring site. More specifically, the range and the rate of change of the range are used to calculate digital thruster power signals while the heading and bearing information are used to calculate digital thruster steering signals. The digital thruster power signals are sent back to data converter 46 over the USB port of computer 48 where they are converted using a serial D/A converter 50 into analog signals for driving the PWM power amplifier 58 and motor 16 shown generally within numeral 44. Digital thruster steering signals are similarly converted by data converter 46 over the USB port and converted by serial D/A Converter 52 into analog signals for driving the PWM power amplifier 54 and steering motor 18 which controls the steering direction of thruster 12 about upright axis A. The thruster heading signal is generated from a feedback potentiometer 57 as a feedback signal to the motor steering control servo amplifier 54.

The use of computer 48 provides the operator with a large degree of flexibility in receiving signals and generating signals in various formats and for different types of motors depending on, for example, the size of the boat. In a preferred embodiment, as shown in FIG. 3, the data converter 46 and computer 48 within the system controller 60 can be embodied within commercially available programmable microcomputer controllers used in industrial process applications may be used for this application.

Controller 60 uses the positional and heading information provided from the GPS receiver 20, compass 38 and thruster heading feedback signal from a feedback potentiometer 57 to calculate range and bearing data in the form of thruster power and steering signals. Switches 66 connected to computer 48 offer the operator the ability to switch between several different modes of operation that are generally dependent on the size of the boat and thruster, as well as prevailing sea conditions. The size of the boat influences the magnitude and duration of thrust signals needed to initiate movement of the boat and to compensate for the momentum once the boat has started moving. Other characteristics related to the physical configuration of the boat such as, for example, the hull displacement, hull drag coefficient, and wetted hull surface area of the boat also affect the mode of operation chosen. Sea conditions such as, wind and water currents, are also a large variable affecting the mode of operation selected.

The system 30 also preferably includes audible feedback via a speaker 70 to advise the operator as to action being taken by the system responsive to input signals from a hand-held remote interface 32. The audible feedback is preferably in the form of voice feedback in the form of synthesized speech.

Yaw Rate Algorithm

Figure 4:
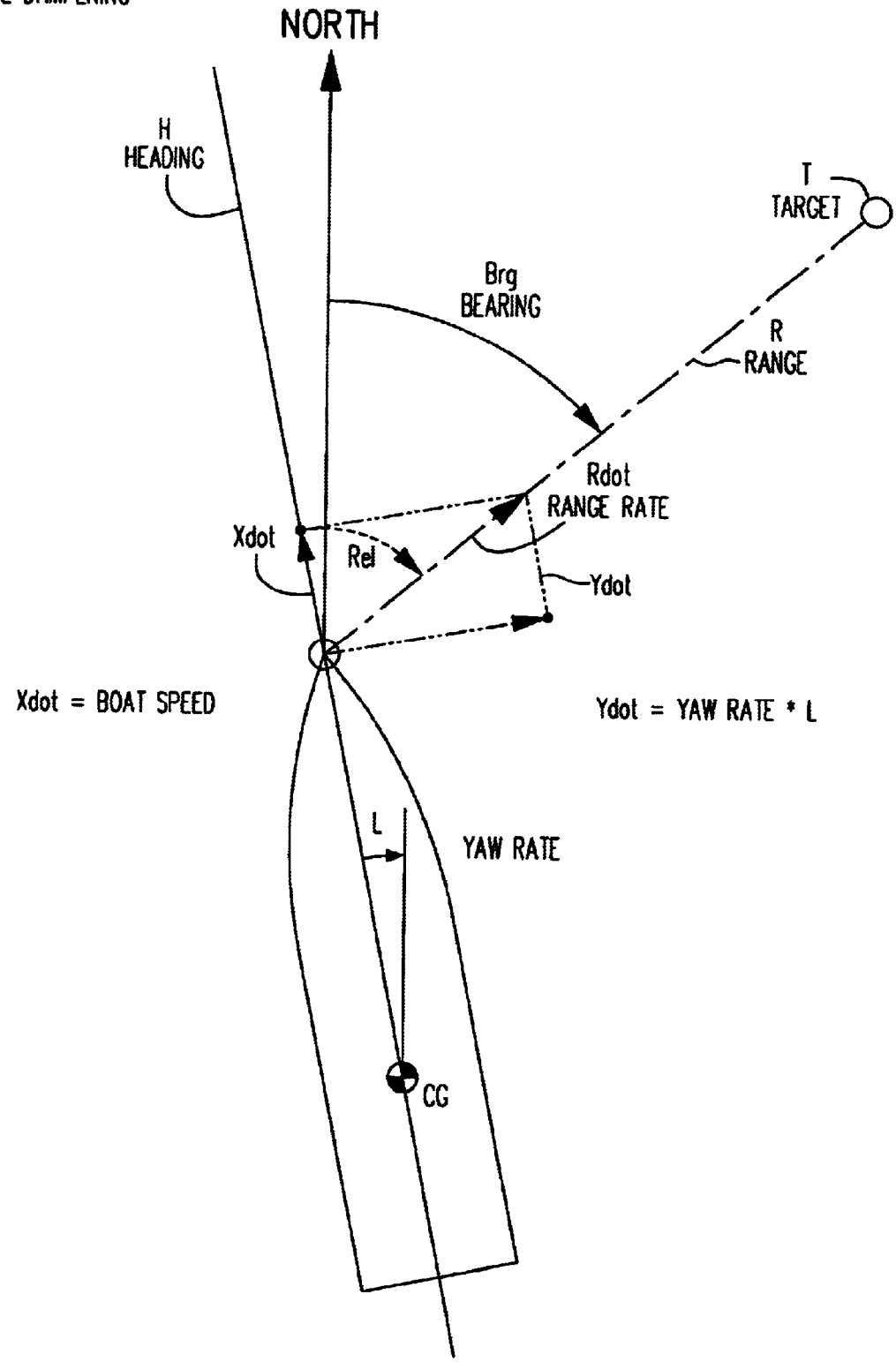
FIG. 4 is a diagrammatic sketch showing the repositioning of a boat in accordance with the invention.

Referring now to FIG. 4, the purpose of the yaw rate algorithm within the computer 48 or controller 60 is to provide additional range velocity damping intelligence to the control system. Range rate Rdot information is derived by differentiating the range R information as determined from GPS position data, which is somewhat noisy. In the absence of a boat's forward velocity sensor, we can still provide some information on the range rate Rdot. This is done by using data from the compass 38 or other boat heading sensing means.

Yaw rate can be determined by differentiating the compass heading Hdg data. The component of range rate Rdot introduced by the yaw rate is equal to the yaw rate times the lever arm L from the center of rotation CG times the sine of relative bearing Rel to the target T as measured in radians. If the boat has a forward velocity sensor, the component of range rate due to forward velocity Xdot would be equal to forward velocity times the cosine of the relative bearing Rel to the target.

Yaw rate Ydot is used to determine a dampening term for range rate Rdot. The magnitude of the range rate Rdot as determined from the yaw rate Ydot is equal to:

$$\text{Range Rate}=Abs[Ydot*\text{Sin}(rel/57.3)]$$

$$\text{Range Rate}=Abs\,[(\text{yaw rate}*L)*\text{Sin}(Rel/57.3)]$$

Note that the sign (±) of the range rate Rdot has to be determined from its effect on range R, i.e. if the range R is diminishing, range rate Rdot is positive. If range R is increasing, range rate Rdot is defined as negative. This connection is arbitrary.

The range rate Rdot contribution from the boats' forward velocity is:

$$\text{Boat speed}\times\text{Cos}(rel/57.3)=Xdot\times\text{Cos}(Rel/57.3)$$

where—

$$\text{Range rate}=\sqrt{\text{Xdot}^{2+\text{Ydot}^2}}$$

Proportional, Integral, and Derivative Control (PID)

The prior art virtual anchor system in U.S. Pat. No. 5,491,636 used a proportion and derivative (PD) control system. With the original PD control system, thrust output was equal to K1 times the range error minus K2 the times the range rate, where K1 and K2 are adjustable parameters. Thrust thus equals:

$$\text{Thrust}=K1*R-K2*Rdot$$

If the disturbing force, wind or current required 20 pounds of thrust to cancel out any motion, the range rate Rdot goes to zero (20 pounds will be used for this discussion as the force required to achieve equilibrium.) Additionally if K1=5 and thrust is at 20#, then the range error would stabilize a value of four meters.

In order to minimize the steady state error typical of Proportional Derivative (PD) control systems, an integral control term is added by taking a slow average of the range error with the averaging time constant adjusted by the value, Kavg. A modification was also made to the PD derived thrust. This was accomplished by adding additional thrust that is proportional to the average range error as follows:

$$\text{Thrust}=K1*R-K2Rdot+K3*AvgR$$

If K3=2*K1, for example (a factor of two was chosen in the implementation), thrust now equals:

$$\text{Thrust}=5*4-0+10*4=60\#$$

This is too much, so that boat moves closer.

At 2 Meters $$\text{Thrust}=5*2-0+10*2=30\#$$

Still a bit too much.

At 1.5 Meters $$\text{Thrust}=5*1.5-0+10*1.5=20\#$$

Just right . . . disturbing force is cancelled out.

Now the system achieves equilibrium at 1.5 meters instead of 4 meters from the target T.

Note that it is possible to have made K3=3 times K1 to achieve an even smaller range error at equilibrium. The system however must be such as to maintain system stability. The integral term can result in an oscillatory condition if the time constant is too small or the K3 value is too large.

Kavg=0.01 which means that the 63% averaging time constant is 100 seconds. The averaging equation is:

$$AvgError=AvgError+Kavg*(Error-AvgError)$$

This gives an exponential function versus time such that the average will integrate to 63 percent in one time constant or 1/Kavg seconds and will achieve almost 100 percent in approximately 5 time constants or 500 seconds.

A still further refinement in controlling thrust and steering angle of a bow thruster is the addition of a fourth independently adjustable constant, K4, modifying the bearing to a desired site or anchoring location as follows:

$$\text{Thrust}=[\{K1*\text{range}\}-\{K2*\text{range rate}\}+\{k3*\text{average range}\}][1-K4*\text{Sine (bearing to site)}]$$

K Factors

K1, K2 and K3 are the basic control system PDI coefficients. K1 is selected based on the thruster size, boat parameters and magnitude of disturbing forces that the system should resist. K1 is the proportional gain coefficient.

K2 is selected to achieve desired dampening and control system stability; thus K2 is the derivative control coefficient.

K3 is selected to reduce the steady state error without jeopardizing system stability; thus K3 is the integral control coefficient.

K4 is selected to suit the boat dynamics in situations where significantly less force is required to yaw the bow of the vessel as compared to moving the vessel forward. Kavg is a fractional value selected to establish the averaging time constant for the average range error computation.

Figures 5A, 5B:
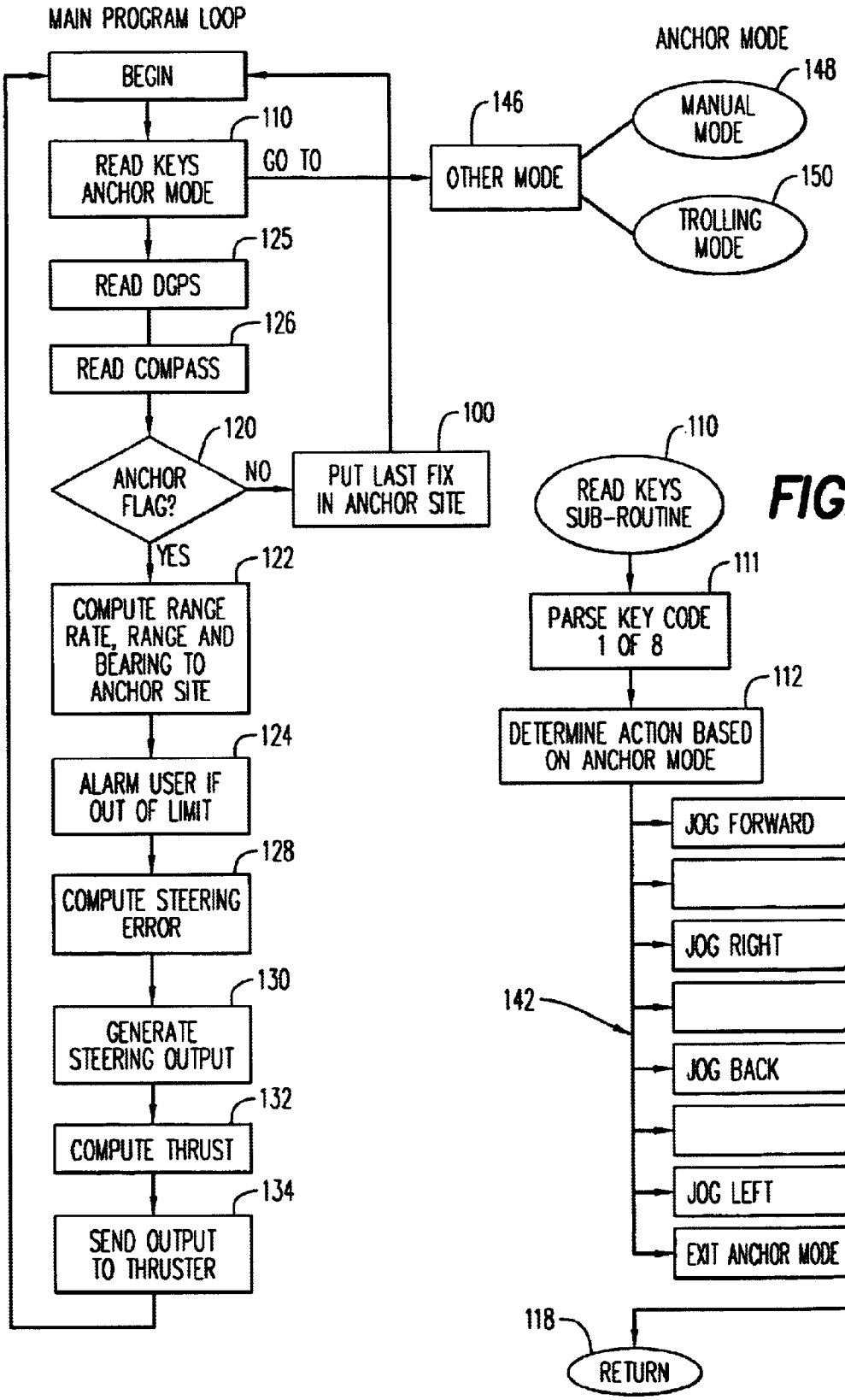
FIGS. 5*a* and 5*b* are flow diagram for maintaining the anchored position of the boat using the system of FIG. 1.
Figure 12:
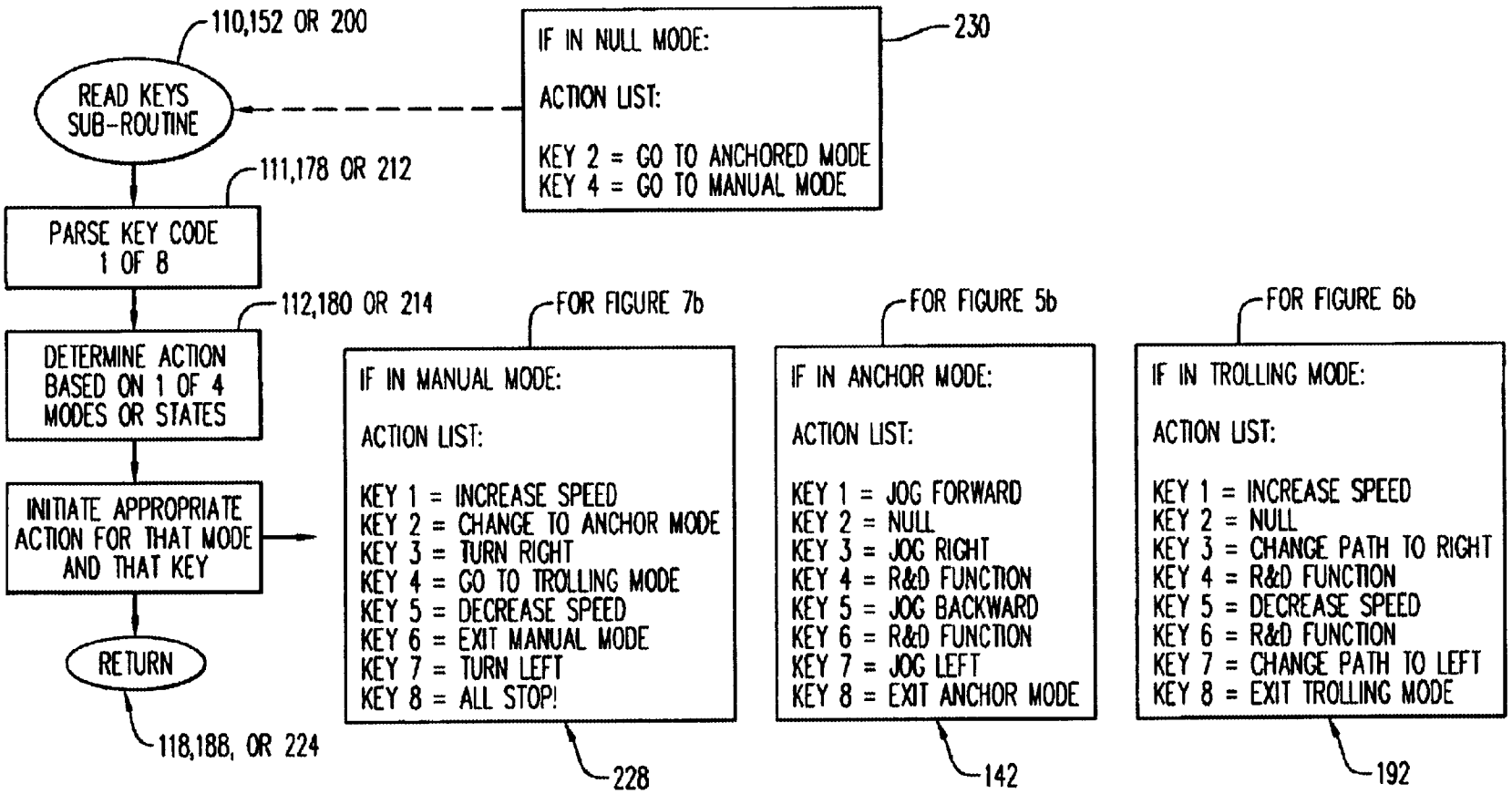
FIG. 12 is a schematic flow diagram of the READ KEYS subroutine or event handler for all modes of operation.

Referring to the flow diagrams of FIGS. 5*a*, 5*b* and 12, the operation of the system 30 is there described. The operator of a vessel, having selected an anchor site simply depresses a button switch located on the remote interface 32. In U.S. Pat. No. 5,491,636, a computer program written in Turbo $C^{++}$ programming language, a product of Borland International, Inc., Scotts Valley, Calif., used information provided from the DGPS receiver 20 and compass 38 to generate signals for controlling thruster 12. Source code software for implementing that system was included as a microfiche appendix. The program included a buffer which is continuously updated with the present position of the boat, even when the boat is not anchored. As in the present application, when the operator selects a desired anchoring position, the positional data in the buffer is stored at 100 (FIG. 5*a*). The present invention features were developed using VISUAL BASIC, a product of Microsoft Corp.

Further, the program includes an event-based call to a subroutine or event handler READ KEYS 110 (FIG. 5*b*) to process commands received from the user wireless remote control device 32. Mode state flags are utilized in the software to monitor the current MODE or STATE of operation and control the software flow accordingly. The READ KEYS event handler 230 in FIG. 13 first determines which key or button has pressed; then it determines which action is assigned to that key in the current mode of operation. If the controller is in the NULL mode, key number 2 at 230 will place the system in the ANCHOR MODE (FIGS. 5*a* and 5*b*) and set the anchor mode flag. Once in this mode, key number 1 at 142 (FIGS. 5*b* and 12) will generate an action call to another subroutine (not shown) which will displace or jog the stored anchoring site approximately one meter forward. Pressing key number 3 will similarly result in displacing or jogging the stored anchoring site approximately one meter to the right. Key number 5 will jog the anchor site to the rear. Key number 7 will jog the anchor site to the left and finally key number 8 will reset the ANCHOR MODE flag and the system will revert to the NULL mode. When READ KEYS event handler 230 completes its task, the program flow returns to the main program loop.

While in the Anchor mode, system 30 continuously maintains the geographic position of the bow, or point of interest, in close proximity to the selected anchoring site. To accomplish this, DGPS receiver 20 continuously at a selectable rate of from once per second to ten times per second, updates the latitudinal and longitudinal position of its antenna 22. By comparing the updated position to the stored anchoring site position, computer 48 continuously calculates the range R (the distance from the bow, or point of interest on the boat to the anchoring site or target T in FIG. 4) and differentiates that range information with respect to time to obtain a range rate Rdot. The computer also calculates the bearing Brg to the anchoring site as measured from true north. (See FIG. 5*a* number 122). If the range value exceeds a pre-established limit at number 124, the program will alarm the operator that the system has been unable to maintain the boat at the anchoring position. The computer next calculates the proper direction of thrust required to move the bow, or point of interest, toward the desired anchoring site. By comparing the bearing Brg to the present boat heading Hdg, a relative thrust direction Rel is calculated at 128 and sent to the thruster steering servo at 130. This steering signal is serially sent via the USB to RS-232 data converter 46 in FIG. 2 to the addressable serial D/A converter 51 as the desired thruster steering angle. This value is compared to feedback potentiometer 57 to generate a steering error signal, which is amplified by PWM servo amplifier 54 to cause steering motor 18 to rotate the thruster to the proper direction.

Next, at 132, the computer determines the appropriate magnitude of thrust based primarily on the remaining range R and present rate of closure Rdot. As described elsewhere in this application, the magnitude of thrust is also determined by an integral term based on a long term average range and further modulated dependent on the angle from the bow. As shown in FIG. 4, the yaw rate can be related to Rdot such that the rate of change of heading can provide another control term if desired. At 134, the computer sends the thrust magnitude serially via the USB to RS-232 data converter 46 in FIG. 2 to the addressable serial D/A converter 50 which establishes the signal to the PWM power amplifier 58 and controls the magnitude of thrust from thrust drive motor 16. D/A converter 50 provides fifteen incremental levels of thrust.

Computer 48 continually loops through this program flow to maintain the bow, or point of interest of the boat, at or very near the desired anchoring site. New steering and thrust magnitude signals are transmitted to the thruster at a selected rate of at least once per second to as fast as ten times per second.

Still referring to FIGS. 5*a* and 5*b*, the operator can use buttons 1, 3, 5 or 7 of the remote control 32 to jog the anchoring site a small amount forward, aft, left or right to place the boat at the position he wishes the system to maintain. When the operator wishes to "pick up anchor" and move on, the operator simply presses button or key number 8 on the wireless remote control device 32 and the computer program 48 will reset the anchor mode flag and revert to the NULL mode of operation, awaiting the next command.

It should be noted that computer 48 generates a synthesized voice response via speaker 70 whenever it acts on a command from the remote control device 32. This provides verbal feedback to the operator, assuring whom, that the system 30 is responding to the command. The synthesized voice can be generated in the appropriate language for the operator. Over thirty separate voice responses are provided.

Figures 6A, 6B:
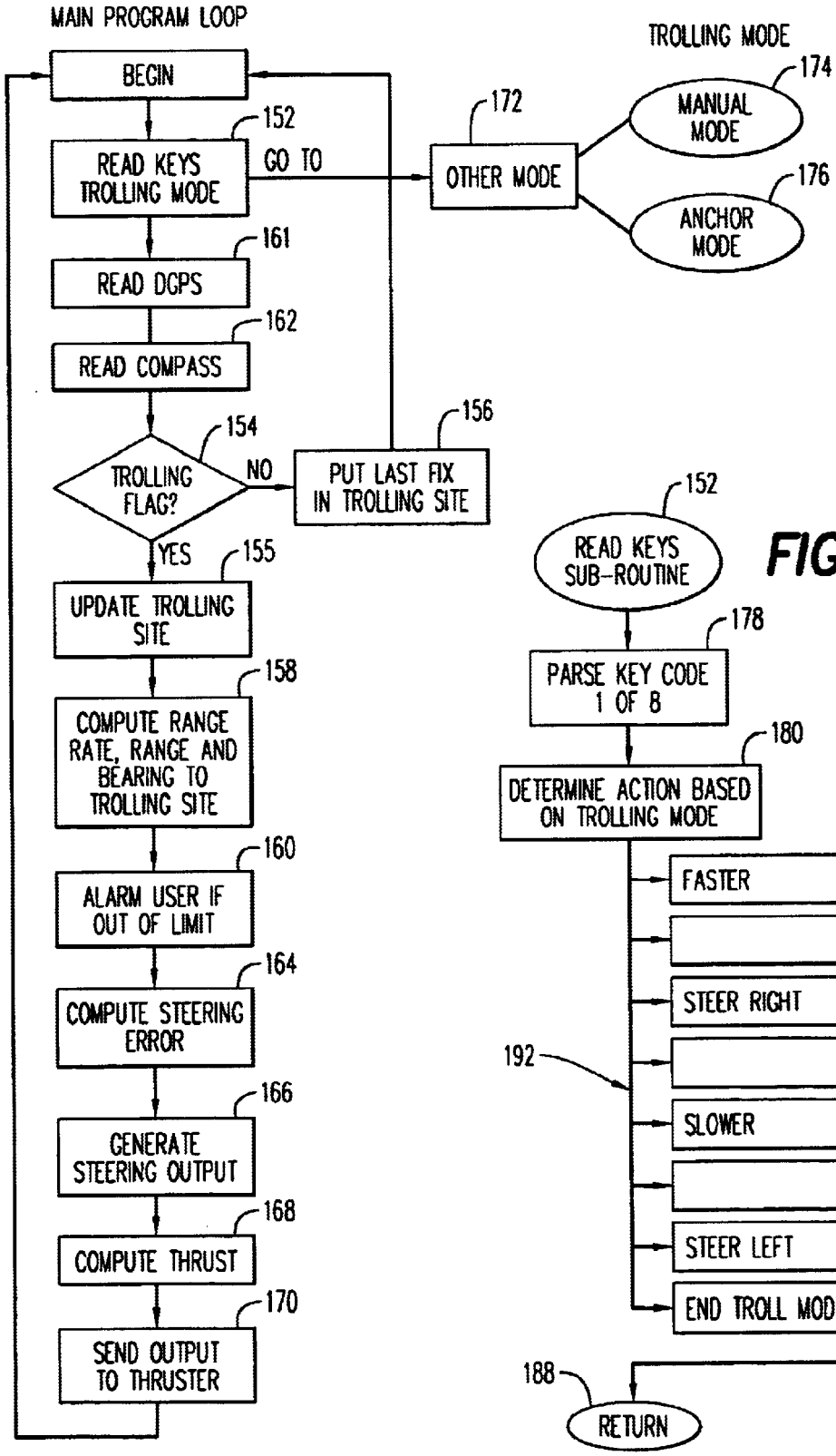
FIGS. 6*a* and 6*b* are flow diagrams for the system's trolling mode.

Referring now to FIGS. 6*a*, 6*b* and 12, the trolling mode of operation of the system 30 is there described. The READ KEYS subroutine or event handler 230 functions substantially in the same manner as described with respect to FIG. 5*b*, with the key press action calls now being appropriate for the trolling mode of operation. In this case, the trolling mode flag would have been previously set by key #4 while the system was operating in the manual mode. The READ KEYS event handler at 230 now interprets the proper actions for each key press that occurs at 178 while the system is in the trolling mode. Pressing key #1 at 192 results in the system making an action call to cause the effective trolling speed to be increased. This is accomplished by enlarging the magnitude with which the anchoring site is displaced during updating in each main program loop. This dynamic or ever-changing anchor site is now referred to as the trolling site. Similarly, key #5 causes the effective trolling speed to be reduced by decrementing the magnitude with which the anchoring or trolling site is displaced during each main program loop. Key #3 causes an action call to another subroutine which modifies the angle, measured from true North, by which the trolling site relocation is recomputed each main program loop. Each #3 key press results in the trolling course being altered by approximately two degrees (2°) to the right. Similarly, key #7 alters the course to the left. Finally, key #8 results in an action to call to reset the trolling mode flag and returns the system to the Null mode of operation.

Figure 7A:
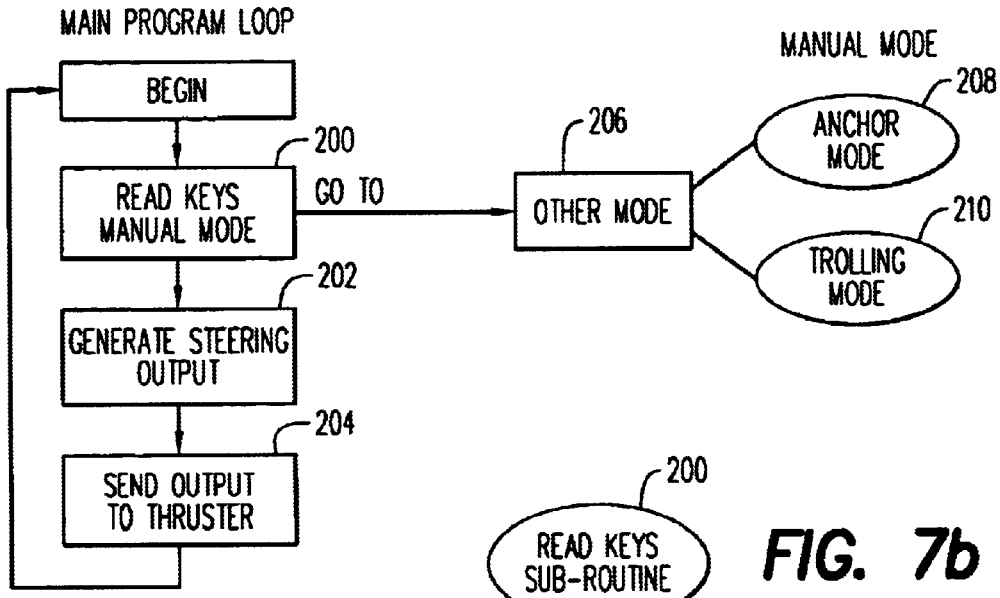
FIGS. 7*a* and 7*b* are flow diagrams showing the system's manual mode.
Figure 7B:
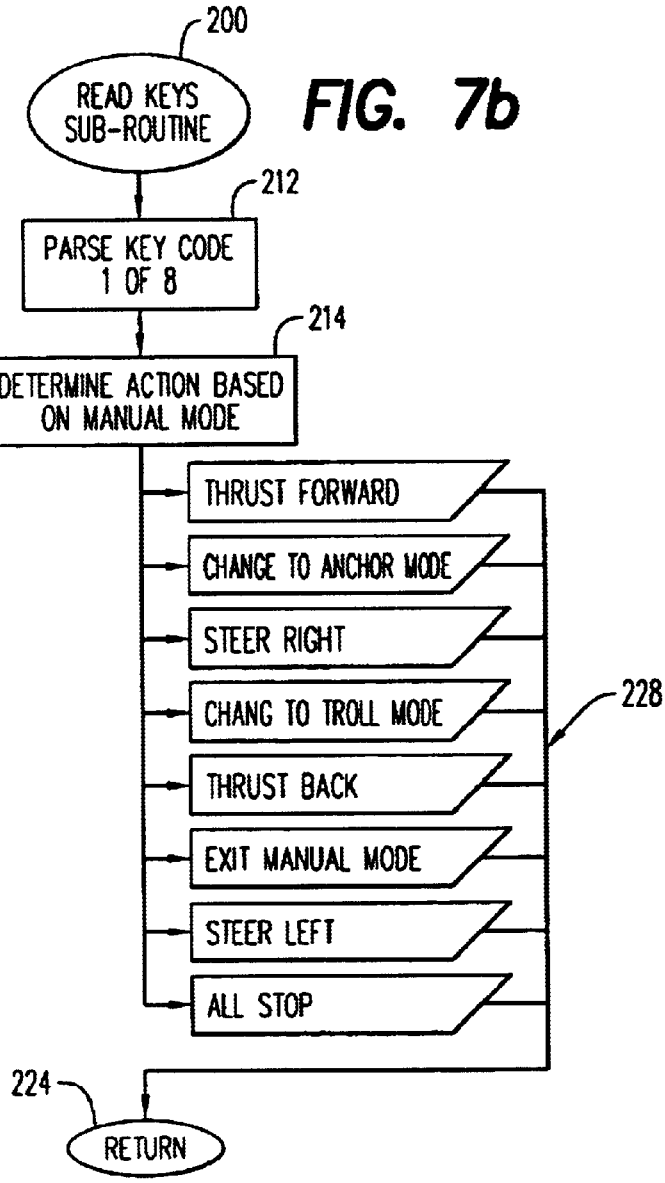

Here again, in FIG. 7*b*, the READ KEYS event handler at 230 functions substantially the same as described with respect to FIGS. 5*b* and 6*b*, with the key press action calls now being appropriate for the manual mode of operation. The manual mode flag would have been previously set while in the null mode of operation by pressing key #4. With the manual mode flag set, the READ KEYS event handler now interprets the proper actions for each key press that occurs while the system is operating in the manual mode. Pressing key #1 at 228 generates an action call to increase the forward thrust causing the boat to move faster. Similarly, key #5 will cause the thrust to be reduced slowing the boat. If the forward thrust is reduced to a negative value, the system will command the thruster to reverse causing the boat to move backwards incrementally faster and faster with each key press. The action call for key #3 will result in a slight turn to the right for each key press and, similarly, key #7 will cause a slight turn to the left for each key press. To facilitate boat handling, key #8 generates an action call to immediately set the thrust to zero and the steering to midship with a single key press. The system can be commanded to exit the manual mode by pressing key #6 which will reset the manual mode flag and revert the system to the null mode. Similarly, key #2 will command the system to go into the anchor mode and will reset the manual mode flag and set the anchor mode flag. Again, in a similar fashion, key #4 will cause the system to leave the manual mode and go into the trolling mode.

Figure 8:
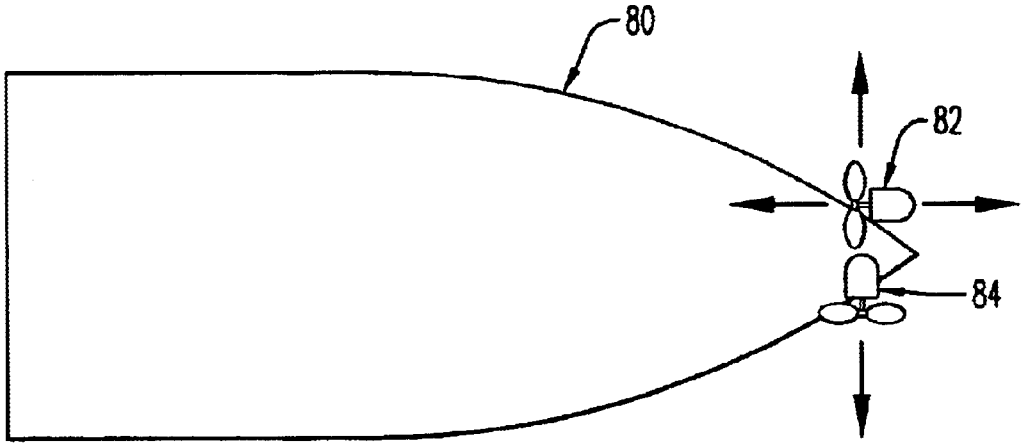
FIG. 8 is a schematic diagram of another embodiment of the invention using a pair of mutually perpendicular fixed thrusters.

Referring now to FIG. 8, to achieve the desired steering thrust vector as described with respect to FIG. 4, this embodiment shown generally at numeral 80 includes two non-steerable thrusters 82 and 84 which are oriented at or in close proximity to the bow of the boat in mutually perpendicular arrangement one to another. By modulating and reversing the direction of thrust selectively and separately in each of the two thrusters 82 and 84, the desired resultant steering thrust vector may be achieved by the controller. The software flow shown in FIG. 5*a* would be slightly modified at 130 and 134 to compute the appropriate thrust magnitude differences required to achieve the desired net thrust vector. It should be recognized that it is not mandatory for the thruster means to be located at the bow, or point of interest, as long as a net resultant force or thrust can be generated with a combination of thrusters to move the bow, or point of interest, in the appropriate direction.

Figure 9:
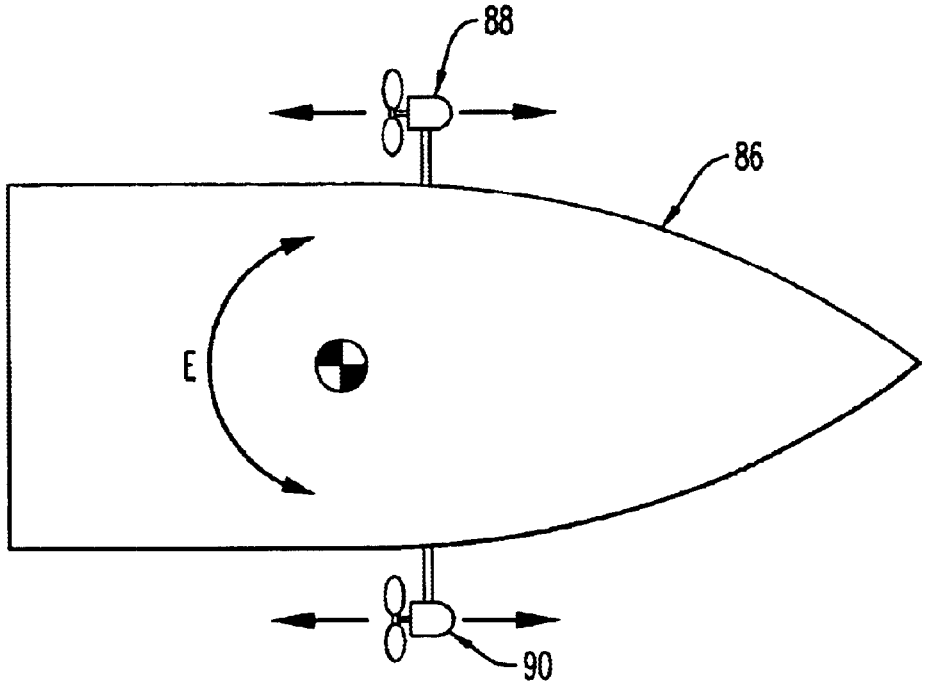
FIG. 9 is a schematic view of yet another embodiment of the invention utilizing spaced apart parallel non-steerable thrusters.

In FIG. 9, still another embodiment shown generally at numeral 86 is there shown. This embodiment 86 includes two spaced apart non-steerable thrusters 88 and 90 each of which may produce a thrust either forward or rearward with respect to the longitudinal axis of the boat or vessel with the magnitude of each thrust being variable as controlled by the controller. By spacing the thrusters 88 and 90 on opposite sides of the boat, the boat 86 may be steered by differential magnitudes of thrust to produce a yaw correction in the direction of arrow E, while the sum of the thrusts can move the boat forward or rearward. The controller program flow for this embodiment would differ slightly from that previously described. The steering output at 130 in FIG. 5*a* would be replaced by a differential thrust computation and the thrust output at 134 would consist of two separate outputs with the appropriate magnitudes to provide the differential steering computed at 130.

Figure 10:
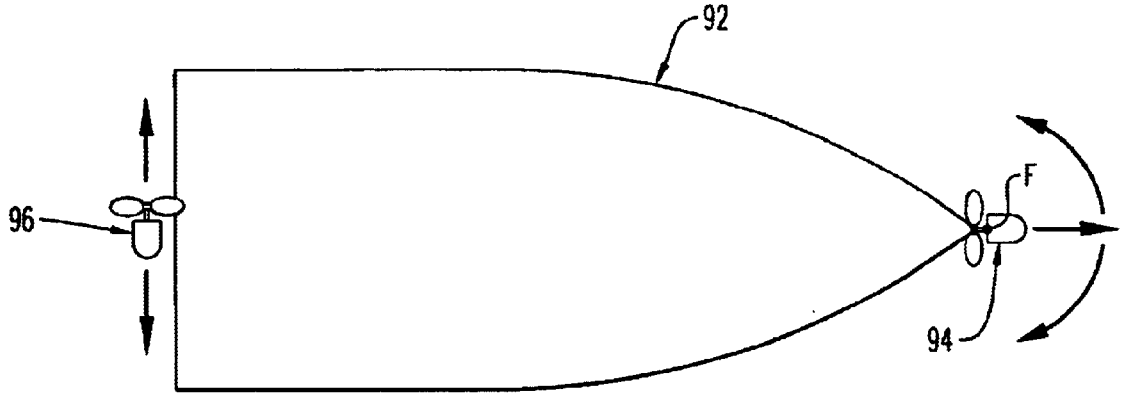
FIG. 10 is a schematic view of still another embodiment of the invention using a steerable bow thruster and a fixed stern thruster.

In FIG. 10, this embodiment 92 includes a front thruster 94 which is steerable about an upright axis F similar to that shown in FIGS. 1A and 1B. However, this embodiment 92 also includes a fixed non-steerable stern thruster 96 which produces only a right or left or athwartship force which is adjustable in magnitude as determined by controller. This stern thruster 96 is used in this embodiment to maintain a constant heading and thus a fixed orientation of the boat while the front thruster 94 is controlled to maintain the anchoring position of the bow of the boat. This embodiment 92 is useful to a fisherman in selectively rotate the boat about a fixed bow location.

Figure 11:
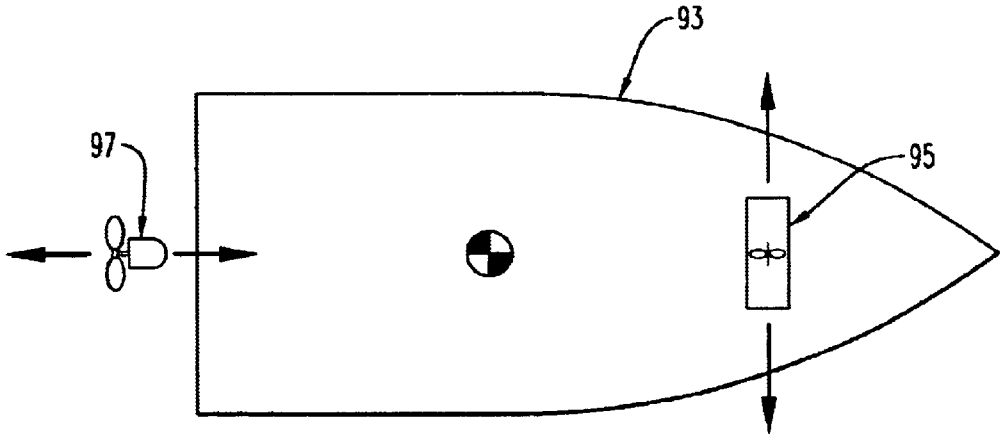
FIG. 11 is a schematic view of still another embodiment of the invention using a bow tunnel thruster and a steerable stern propulsion unit.

In FIG. 11, this embodiment 93 makes use of a tunnel thruster 95 mounted in the hull of the vessel near the bow which can generate only an athwartship or a left or right yawing thrust to turn the boat 93 in the desired direction. When the boat 93 is pointed at the selected anchoring site, a stern propulsion unit 97 provides the forward or aft thrust to move the boat 93 to the anchoring site and to oppose the disturbing force of wind or water current. The controller software for this thruster combination 95 and 97 is slightly different than that shown. The steering output at 130 in FIG. 5*a* would be sent to the tunnel thruster 95 and the thruster output at 134 would be sent to the stern propulsion unit 97 only after the steering error has been reduced to less than five degrees.

Figure 13:
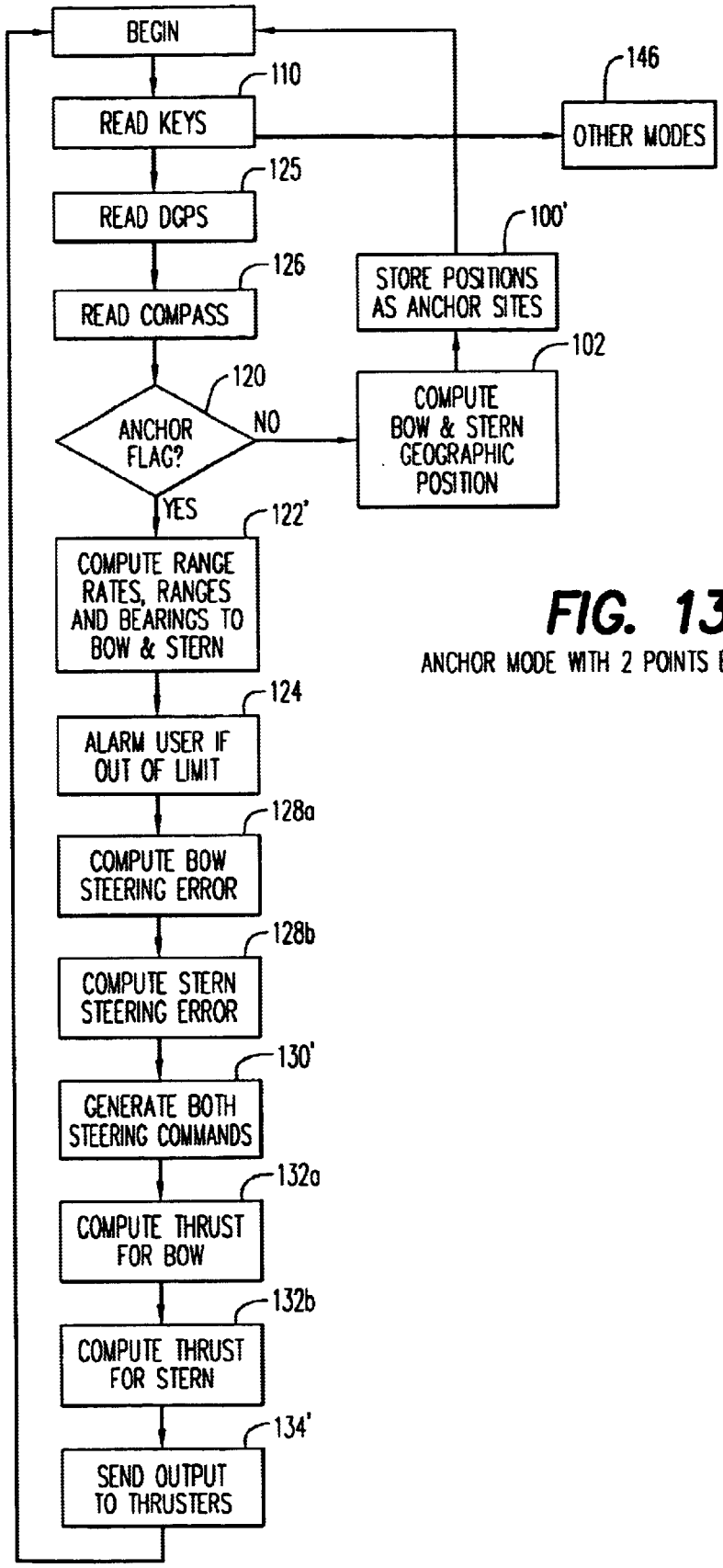
FIG. 13 is a system flow diagram in the anchor mode of operation utilizing two thrusters.

Referring now to FIG. 13, the operation of the system of the present invention with two thrusters which will not only establish and maintain alignment of between a geographic location selected by the operator and a point of interest on the vessel, but will also maintain the orientation of the boat and/or the controlling movement and positioning of a second point of interest on the boat which is determined through the mathematical transformations described herebelow. The operation of this two thruster system in FIG. 12 is similar to that described with respect to the single rotatable thruster of FIG. 5*a* in the anchor mode. Read keys 110 processes commands from the user remote control interface 32. A mode state flag at 120 monitors the current mode of operation. The system operational flow logic is not repeated here but is substantially similar to that with respect to FIG. 5*a* with the following additions. Note that multiple points of geographic locations or positions may also be entered as separate anchor sites at 100'. The controller will then compute both bow and stern geographic positions at 102, which transformation calculations may include or be substituted for other points of interest on or in close proximity to the boat, including the location of the antenna. At 122', the controller not only computes the range rates and bearings of the bow with respect to the anchor site but also the stern or other points of interest. Steering error of the stern or other points of interest are also calculated at 128*b* followed by control signals for the bow and stern thrusters at 132*a* and 132*b* where the system includes that multi-thruster arrangement. Note that the control signals for other multiple thruster variations described herein would be alternately generated depending upon the particular multi-thruster arrangement.

The System Generally

The following describes a vessel positioning system comprising a precision position sensing means, a direction sensing means and a steerable thrust means which applies thrust as required to maintain the bow or other point of interest of the boat at a selected geographic location. A precision measuring device such as a differential GPS (DGPS) receiver, using United States Coast Guard differential GPS corrections or the Federal Aviation Administration Wide Area Augmentation System (WAAS), or other differential corrections means, such as Omni Star or one privately established using a base reference station and private data link, is used to measure the geographic position of the bow of the boat by placing the GPS antenna at or near the bow. The antenna may also be placed at any point in three-dimensional space relative to the bow. The bow's location or any other point of interest including the antenna location is then determined from the known antenna location by an Euler-type mathematical transformation described below.

In one embodiment, a steerable thruster is mounted in proximity to the bow of the boat. A computing device or control system compares the measured position to the desired position to determine the magnitude and direction of the corrective thrust required to oppose any disturbing forces which tend to displace the boat from the desired position. The control system then causes the appropriate amount of thrust to be vectored in the appropriate direction to maintain the boat's desired position. The bow is the logical position from which to reference the anchoring location because the boat will assume a natural trailing position determined by the disturbing forces. It is important to recognize however that any point on the boat could be used as the reference point.

Velocity Damping

Rate information allows the control system to regulate the applied thrust to bring the boat to the desired position with the velocity of the bow movement approaching zero at the same time the position displacement, or range error is approaching zero. Rate information is obtained by differentiating, with respect to time, the range information derived from comparing the present bow location to the desired bow location anchoring site. Rate information could also be obtained by incorporating a means for measuring the velocity of the bow of the boat through the water. As shown in FIG. 4, a component of range rate information can also be estimated by differentiating the boat heading information from the compass, with respect to time to obtain a yaw rate. Given information of both the yaw rate and the forward velocity, the range rate can be calculated.

Proportional Integral Derivative Control

A position control system with only position (proportional) and rate (derivative) information will have an average position offset error proportional to the gain of the control system. The larger the disturbing force, the larger the position error at equilibrium. Equilibrium is the point at which the thruster force equals the net disturbing force caused by wind, water current or waves acting on the boat. At equilibrium the forces cancel each other and velocity goes to zero.

For example, a system with a gain of 10 lbs. thrust per meter of range error will have a range error of one meter at equilibrium when subject to a steady disturbing force of 10 lbs. In steady state conditions, an integral feedback term could be added to compensate for the steady state error. In the practical case where measurement noise is a significant factor, the position error can be averaged over time to determine the corrective action needed to reduce the steady state toward zero.

In practice, some degree of measuring system noise will be encountered and the disturbing forces will be variable such that a true steady state condition is rarely achieved. In this invention, a "slow averaging" technique involving integration of the range information over a long period of time, is used to determine the average position error, which is representative of the average disturbing force. The control system uses this integral term to apply additional thrust to reduce the average range error.

Thruster steering angle relative to the boat Rel is determined by comparing the true bearing Brg from the bow of the boat to the anchoring site with the present heading Hdg of the boat.

The dynamics of the typical boat are such that, with the thruster mounted at the bow, less thrust magnitude is required at the bow location to yaw the boat left or right than is required to move the boat forward or backward. If the anchoring site is to the left or right of the bow, much less thrust is required to move the bow laterally to the anchoring site. In this invention, the thrust is modulated as a function of the steering angle to take these dynamics into account.

Thrusters

A number of thrust arrangements are implemented as part of the anchoring system depending on the boat application. Small vessels implement an electric motor, which uses DC voltage to power a DC motor for both thrust and steering. For larger vessels, a Voight-Schneider cyclodial thruster or hydraulically powered Azimuth thruster is more appropriate. It is only necessary for the thruster to be located at the bow of point of interest, when a single thruster is provided. With a plurality of thrusters, it is possible to generate the desired thrust vector with a variety of thruster arrangements.

A thruster arrangement as shown in FIG. 8 can be utilized to generate a net resultant thrust vector in any desired direction by separately controlling the magnitude of thrust from thrusters 82 and 84.

A thruster arrangement as shown in FIG. 8, can be utilized to generate a net resultant thrust vector in any desired direction by separately controlling the magnitude of thrust from thrusters 82 and 84. The thruster arrangement shown in FIG. 9, reminiscent of paddle-wheeler boats, also provides a method of achieving a net thrust vector controllable By separately controlling the magnitude and direction (forward or reverse) of each thruster. FIGS. 10 and 11 and show other thruster combinations. Probably the most common arrangement for larger yachts would be steerable stern thrusters combined with a tunnel thruster near the bow.

User Interface

The User Interface to the anchoring system is implemented with a wireless remote control device. The hand held remote control device has several control buttons, with which the user, or operator, can issue commands to the anchoring control system. The anchoring control system generates voice responses informing the user or operator as to the action being undertaken by the control system. The system provides over thirty separate synthesized voice responses. The voice can be female or male and the language can be chosen.

Operational Modes

Three operational modes of the anchoring system are provided in addition to its standby or NULL mode, namely the ANCHOR mode, a MANUAL mode and a TROLLING mode. The Anchor mode is the primary purpose of the system. The Manual mode brings the thruster under direct control of the operator of the boat. In the manual mode, the user can separately control the direction and magnitude of the thrust so as to move the boat to another location under his control. In the Trolling mode, the system moves the boat, at a constant speed, along a selected track or course line. The control system accomplishes this by constantly moving the anchoring site along a track. It should be noted that this method, used by the anchoring system, is superior to merely maintaining a compass heading. With this method, the bow of the boat will follow the track, with little or no cross-track error, even though a disturbing wind or current would tend to deflect it from its course. If merely a compass heading is held, the boat will be deflected from the desired track by any lateral disturbing forces thus creating cross-track error.

Controlled Boat Orientation

With both bow and stern locations determined using the preceding mathematics, the orientation of the boat may now be controlled by adding a second steerable thruster placed at the stern and controlling it in a similar manner as previously described for the bow thruster. When the geographic locations of both the bow and the stern are being substantially maintained at their respective locations, all points on the boat are therefore being maintained stationary and thus, orientation of the boat with respect to heading is also maintained.

Orientation of the boat can also be controlled by virtually anchoring the bow as previously described and using a second fixed thruster, as shown in FIG. 10 to simultaneously control the boat's heading to a constant angle with respect to true north.

It obviously requires more energy to control both orientation and bow position when compared to merely maintaining the bow position and allowing the boat to trail, naturally aligning itself as the prevailing wind and sea current forces.

Translating Antenna Location

This feature of the system 30 adds an additional capability in the form of Euler transformation computations to allow the DGPS receiver antenna to be displaced from the point of interest. The DGPS receiver's NMEA data output is representative of the geographical location of the antenna. To determine the geographic location of any other point on the boat, Euler transformation mathematics can be utilized. If the DGPS antenna is located on a high mast, Roll and Pitch motions of the vessel can cause the antenna to move and Euler transformations can be used to compensate for these movements. If the antenna is relatively low and/or no pitch and roll movements are considered, these calculations become simplistic.

If the vessel is assumed to be a rigid body, the DGPS antenna location in relation to any point of interest on the vessel can be readily measured in body-fixed three-dimensional coordinates. For example: to relate a mast mounted DGPS antenna to the bow of the vessel, measure how far aft (dx) how far abeam (dy) and how far up (dz) the two locations are separated.

Normally the body-fixed coordinate system is related to the center of gravity (CG) of the vessel. In fixed body coordinates, the antenna is located as x(a), y(a) and z(a) and the bow is located at x(b), y(b) and z(b). The displacement of the antenna from the bow can be described as a vector D where:

$$dx=x(b)-x(a)$$

$$dy=y(b)-y(a)$$

$$dz=z(b)-z(a)$$

Rotations can occur about the heading, roll and pitch axes. The GPS receiver determines the East, North and up location of the antenna in earth fixed coordinates. If interested in the East, North, up location of the bow of the vessel, translate the measurements using an Euler transformation or Euler rotation matrix as follows:

$$P(\text{bow}) = P(\text{ant}) + P(\text{offset}) \text{ and } P(\text{offset}) - R*D$$

$$\begin{vmatrix} E(b) \\ N(b) \\ U(b) \end{vmatrix} = \begin{vmatrix} E(a) \\ N(a) \\ U(a) \end{vmatrix} + \begin{vmatrix} E(o) \\ N(o) \\ U(o) \end{vmatrix}$$

and $$\begin{vmatrix} E(o) \\ N(o) \\ U(o) \end{vmatrix} = Rx \begin{vmatrix} dx \\ dy \\ dz \end{vmatrix}$$

R(COL, ROW) H=heading R=roll P-pitch $$R(0,0)=\text{Cos}(H)*\text{Cos}(R)$$

$$R(1,0)=-\text{Sin}(H)*\text{Cos}(R)$$

$$R(2,0)=\text{Sin}(R)$$

$$R(0,1)=\text{Sin}(H)*\text{Cos}(P)+\text{Cos}(H)*\text{Sin}(R)*\text{Sin}(P)$$

$$R(1,1)=\text{Cos}(H)*\text{Cos}(P)-\text{Sin}(H)*\text{Sin}(R)*\text{Sin}(P)$$

$$R(2,1)=-\text{Cos}(R)*\text{Sin}(P)$$

$$R(0,2)=\text{Sin}(H)*\text{Sin}(P)-\text{Cos}(H)*\text{Sin}(R)*\text{Sin}(P)$$

$$R(1,2)-\text{Cos}(H)*\text{Sin}(P)+\text{Sin}(H)*\text{Sin}(R)*\text{Cos}(P)$$

$$R(2,2)=\text{Cos}(R)*\text{Cos}(P)$$

The Euler rotation matrix therefore is:

$$[R] = \begin{vmatrix} \text{Cos}(H)*\text{Cos}(R) & -\text{Sin}(H)*\text{Cos}(R) & \text{Sin}(R) \\ \text{Sin}(H)*\text{Cos}(P)+\text{Cos}(H)*\text{Sin}(R)*\text{Sin}(P) & \text{Cos}(H)*\text{Cos}(P)-\text{Sin}(H)*\text{Sin}(R)*\text{Sin}(P) & -\text{Cos}(R)*\text{Sin}(P) \\ \text{Sin}(H)*\text{Sin}(P)-\text{Cos}(H)*\text{Sin}(R)*\text{Sin}(P) & \text{Cos}(H)*\text{Sin}(P)+\text{Sin}(H)*\text{Sin}(R)*\text{Cos}(P) & \text{Cos}(R)*\text{Cos}(P) \end{vmatrix}$$

If measurements of heading, roll and pitch can be determined, this transformation matrix allows relating the GPS antenna position measurements to any other location on the vessel. This is necessary for large vessels where the GPS antenna may be mounted at a considerable distance from the center of gravity of the vessel and from the point that one wishes to geographically locate.

Using a special GPS attitude sensing receiver with an array of GPS antennas, it is possible to measure heading, roll, pitch and geographic position with one device. However, for a small vessel such as a bass fishing boat, the GPS antenna motions due to pitch and roll are relatively small. If Pitch and Roll are ignored, the rotation matrix is reduced to a single rotation representing boat heading as follows:

$$[R] = \begin{vmatrix} \mathrm{Cos}(H) & -\mathrm{Sin}(H) & 0 \\ \mathrm{Sin}(H) & \mathrm{Cos}(H) & 0 \\ 0 & 0 & 1 \end{vmatrix}$$

If the GPS antenna is displaced at a known position relative to the bow, or point of interest, the GPS position can be translated by measuring boat heading and using this simple rotation matrix.

If the GPS antenna placement is constrained to the centerline of the vessel, the mathematics is further simplified. In this case the equations reduce to the following:

East offset in meters=$L$*Sin(Heading)

North offset=$L$*cos(Heading)

Where L=the distance (in meters) of the GPS antenna from the bow or point of interest.

Stern Thruster

With both bow and stern locations determined, a second thruster may be placed at the stern as seen in FIG. 1*b*. This second thruster 26 with propeller 28, along with the stern position determined by Euler Transformation, is used by the system software and control hardware to determine and control the stern position so as to result in the vessel maintaining an anchored position with a user defined heading. Two distinct configurations are specified. One is where the stern thruster 26 is steerable about axis B. The other (not shown) is where the stern thruster is mounted perpendicular to the centerline of the vessel and is fixed in position and generates thrust in the awarthship direction, i.e. to the right and left, perpendicular to the center line of the vessel.

Broad Concept

In the embodiment of the invention which utilizes only a single steerable thruster, preferably positioned in close proximity to the bow of the boat, the anchoring mode of operation can be activated to maintain the bow located at a selected geographic location with improved accuracy utilizing the above features of this form of the invention. The system produces a thrust force in the correct direction and magnitude to maintain the bow, or point of interest, in agreement with the selected geographic anchoring site or point. In this embodiment, the point of interest (the bow) is substantially (virtually) anchored and the boat is then allowed pivot or swing about the anchor point as sea and wind conditions dictate. The operator of the boat can use the remote control device to jog the anchoring site to the left, right, forward or back.

An additional feature of the unique single thruster system is the ability to utilize mathematical transformation equations to determine the geographic location of the "point of interest" without having to locate the GPS antenna directly over the point of interest. In this embodiment, the point of interest (the bow) is anchored and the boat is then allowed to pivot or swing freely, as sea and wind conditions dictate, about the geographic anchor point with which the point of interest is established and maintained in substantial alignment.

The manual mode of operation allows the operator of the boat to command the direction and magnitude of the same thruster means to manually reposition or move the boat. The trolling mode of operation causes the system to compute a track or course, along which the bow of the boat will be forced to follow. This is accomplished by displacing the virtual anchoring point a prescribed distance each computation cycle. The boat will never catch up with this moving anchor point and the thruster will generate sufficient thrust to achieve the desired trolling speed, which is established by the magnitude of displacement of the anchoring site each computational cycle. The operator of the boat can use his remote control device to alter the track heading and/or the effective trolling speed. An advantage of this method is that the boat will follow the prescribed track with little or no cross-track error even under the influence of disturbing wind or sea current.

By introducing a second steerable thruster and appropriate software, the same DGPS receiver, compass and controller can be programmed, in another embodiment, to control both thrusters so as to effectively anchor two points of interest, preferably the bow and the stern; the second point being related to the first point by the dimensions of the boat. With any two points of the boat anchored, the orientation, or heading, of the boat is maintained and all points on the boat are essentially anchored.

An alternate technique can obtain the same result by anchoring one point of interest and controlling the heading of the boat. This allows the second thruster to be non-steerable. It can be mounted in a manner to generate a left or right yawing action as required to maintain a constant boat heading as selected by the operator. The first thruster would operate in the previously described fashion to anchor the bow, or point of interest. Again this results in all points on the being essentially anchored.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the invention so as to embrace any and all equivalent apparatus and articles.

What is claimed is:

1. A system for substantially controlling the geographic position of the bow, or other part of a boat in water at a location selected by an operator of the boat thus virtually anchoring the boat, the system comprising:

a thruster means located in proximity to the bow, or point of interest, of the boat, said thruster capable of producing a steerable thrust force to move the boat to the selected location, or virtual anchoring point, within the water, said thruster means providing a thruster heading signal equal to the relative angle between the heading of the boat and that of said thruster;

a DGPS or WAAS enabled receiver and antenna located onboard the boat for receiving signals from differential correction sources and GPS satellites, said receiver providing information as to the geographical position of said antenna, said antenna being located at a second point of interest on the boat;

an electronic means compass for providing current heading indication signals representative of the heading of the boat;

a controller receiving the information signals from said GPS receiver, said compass and the thruster heading signal, said thruster providing output signals to said thruster to control the direction and magnitude of the thrust, these output signals being computed as based on the calculated range and bearing to the desired anchoring site and upon the rate of change of range to the anchoring site;

a wireless manually activated remote control interface with which the operator of said boat can issue commands to said controller to control its mode of operation;

whereby the system can be commanded to operate in a trolling mode, said controller calculating a straight course in a desired direction and continually calculating a new anchoring site along that course or track such that the bow of the boat is forced to continuously follow that track with little or no cross-track error and wherein said remote control can be used to issue commands to increase or decrease the apparent trolling speed of the boat by having the controller displace the continuous moving anchor site an appropriate distance each computation cycle, said remote control interface providing the operator a means of altering the trolling speed and direction.

2. A system as set forth in claim 1, wherein:

the controller adjusts the magnitude of the thrust control signal based upon a long term average of range taken over an extended period of time and the thrust output signal is expressed substantially as:

$$\text{thrust}=[K1*\text{range}]-[K2*\text{range rate}]+[K3*\text{average range}]$$

wherein K1, K2 and K3 are independently adjustable software constants and range rate is defined as being positive when range is decreasing and negative when range is increasing.

3. A system as set forth in claim 1, wherein: the system can be commanded to operate in a manual mode, said remote control and said controller then being used to control the direction and magnitude of the thrust from the thruster means in accordance with the boat operator's remote control commands.

4. A system as set forth in claim 1, wherein:

the antenna of said DGPS or WAAS enabled receiver is displaced horizontally from the thruster means and said controller performing the necessary mathematical transformations to determine the geographic position of the point of interest based on the placement of the antenna and the GPS receiver's information of the antenna's geographic location.

5. A system as set forth in claim 1, wherein:

said controller can store the geographic coordinates of multiple anchoring points such that the operator of the boat can command the system to move or return the boat to any one of those stored or remembered locations.

6. A system similar to that set forth in claim 1, wherein:

one of point of interest on the boat is substantially maintained at a constant geographic location and the orientation, or heading of the boat, is also maintained at a constant angle, a second thruster means for providing a yaw thrust force to rotate the boat about its center of gravity in azimuth;

said controller, also issuing output signals to the second thruster means as required to maintain a constant boat heading thus controlling the orientation of the boat.

7. A system similar to that set forth in claim 1, wherein:

two points of interest on the boat are substantially maintained at constant geographical locations thus controlling the orientation of the boat as well as its geographic location;

said thruster means comprising at least two thrusters, one said thruster located at the bow, or first point of interest, and the second said thruster located at the stern, or second point of interest;

said controller computing the geographic location of both points of interest based on the antenna's geographic location information received from the DGPS receiver and also computing the appropriate thrust magnitudes and directions for each of the said thrusters based on the two sets of ranges and range rates.

8. A system as set forth in claim 1, wherein:

said controller modulates the magnitude of the thrust as a function of the bearing angle from the bow to the anchoring site and the thrust output signal is expressed substantially as:

$$\text{thrust}=[[K1*\text{range}]-[K2*\text{range rate}]+[K3*\text{average range}]]*[1-K4*\text{Sine(bearing to site)}]$$

wherein K1, K2, K3 and K4 are independently software adjustable constants and range rate is defined as being positive when range is decreasing and negative when range is increasing.

9. A system for substantially controlling the position of a boat in water at a geographic location selected by an operator of the boat, the system comprising:

a thruster attached in proximity to the bow of the boat, said thruster rotatable about an upright shaft axis and driven by a power source for producing a steering thrust vector capable of moving the boat to the selected location within the water, said thruster providing a thruster heading feedback signal equal to the relative angle between the heading of the boat and that of said thruster;

a DGPS or WAAS-enabled receiver and antenna located onboard the boat for receiving signals from GPS satellites and differential correction signals from another source, said receiver providing position information signals indicative of the position of said antenna in a differential OPS mode of operation based on said signals from the GPS satellites and the differential correction signal source;

an electronic compass for providing current heading indication signals representative of the heading of the boat;

a controller receiving input signals from said receiver, said compass and the thruster feedback signal, said controller providing control signals to said thruster to produce the steering thrust vector for steering and propelling the boat to the selected anchoring location, the control signals based upon the range, bearing, magnitude and rate of change in range information, said control signals including a variable thrust signal whose magnitude is dependent on the direction, magnitude and rate of change in range;

a wireless manually actuated remote interface for transmitting control signals to said controller, said controller providing audible responses to inform an operator as to actions taken by said controller;

the magnitude of said thrust signal being modulated to dampen the velocity of the boat as a desired position is approached based upon the range rate as modified by the yaw rate of the boat.

10. A system as set forth in claim 9, wherein:

the magnitude of said thrust signal is also based upon a long term average range error taken over an extended time period of at least about five seconds and is expressed substantially as:

$$\text{thrust}=[K1*\text{range}]-[K2*\text{range rate}]+[K3\ \text{average range error}]$$

wherein K1, K2 and K3 are independently adjustable constants and range rate equals the velocity toward (+) or away from (−) a selected location.

11. A system as set forth in claim 9, further comprising:

a non-steerable rear thruster positioned at the stern of the boat, said rear thruster producing a variable lateral or athwartship thrust responsive to a separate control signal from said controller.

12. A system as set forth in claim 9, wherein:

said system is programmed by said remote interface to operate in a trolling mode, said controller establishing a straight course in a desired direction along a track line and then providing control signals to said thruster to move the boat along the track line without substantial variance therefrom.

13. A system as set forth in claim 9, wherein:

said controller is programmable to receive and store multiple selected anchor locations each of which may be established by said remote interface as a desired position to which the boat will be propelled by said thruster.

14. A system as set forth in claim 9, wherein:

said controller is programmed to selectively operate said system in an anchor mode, a trolling mode or a manual mode.

15. A system for substantially establishing and controlling the position of a boat in water at a selected geographic location by an operator of the boat, the system comprising:

a thruster attached at or in close proximity to the bow of the boat, said thruster rotatable about an upright shaft axis and driven by a power source for moving the boat to a selected location within the water, said thruster providing a thruster heading feedback signal equal to the relative angle between the heading of the boat and that of said thruster;

a DGPS or WAAS-enabled receiver located onboard the boat for receiving signals from GPS satellites and differential correction signals from another source, said receiver providing position information signals indicative of the position of the thruster in a differential GPS mode of operation based on said signals from the GPS satellites and the differential correction signal source;

an electronic compass for providing current heading indication signals representative of the true heading of the boat;

a controller receiving input signals from said DGPS capable receiver, said compass and a feedback thruster steering signal equal to the relative angle between the heading of the boat and that of said thruster, said controller providing control signals to said thruster for steering and propelling the boat to the selected location, the control signals based upon the range, bearing, magnitude and rate of change in range information, said control signals including a variable thrust signal whose magnitude is dependent on the direction, magnitude and rate of change in range and are expressed substantially as:

$$[\text{range}*K1]-[\text{range rate}*K2]+[\text{average range error}*K3]$$

wherein K1, K2 and K3 are independently adjustable constants, range rate is the velocity toward or away from the selected location, and average range error is taken over a time period of at least five seconds;

a wireless manually actuated remote interface for transmitting control signals to said controller, said controller producing audible responses relative to action taken by said controller.

16. A system as set forth in claim 15, wherein:

said controller is programmed to selectively operate said system in an anchor mode, a trolling mode or a manual mode.

17. A system as set forth in claim 15, wherein:

the magnitude of said thrust signal is modulated to dampen the velocity of the boat as a desired position is approached based upon the range rate as modified by the yaw rate of the boat.

18. A system as set forth in claim 15, further comprising:

a non-steerable rear thruster positioned at the stern of the boat, said rear thruster producing a variable lateral or athwartship thrust responsive to a separate control signal from said controller.

19. A system as set forth in claim 15, wherein:

said system is programmed by said remote interface to operate in a trolling mode, said controller establishing a straight course in a desired direction along a track line and then providing control signals to said thruster to move the boat along the track line without substantial variance therefrom.

20. A system as set forth in claim 15, wherein:

said controller is programmable to receive and store multiple selected anchor locations each of which may be established by said remote interface as a desired position to which the boat will be propelled by said thruster.

21. A system for establishing and substantially controlling the position of a boat in water with respect to a geographic location selected by an operator of the boat, the system comprising:

a thruster attached in proximity to the bow of the boat, said thruster rotatable about an upright shaft axis and driven by a power source for moving the boat to a selected location within the water, said thruster providing a thruster heading feedback signal equal to the relative angle between the heading of the boat and that of said thruster;

a DGPS or WAAS-enabled receiver located onboard the boat and having a signal receiving antenna spaced on the boat a substantial horizontal distance from said thruster, said receiver for receiving signals from GPS satellites and differential correction signals from another source, said receiver providing position information signals indicative of the position of the antenna in a differential GPS mode of operation based on said signals from the GPS satellites and the differential correction signal source;

an electronic compass for providing current heading indication signals representative of the true heading of the boat;

a controller receiving input signals from said receiver, said compass and a feedback thruster steering signal equal to the relative angle between the heading of the boat and that of said thruster, said controller providing control signals to said thruster for producing a steering thrust vector which steers and propels the boat to the selected geographic location, the control signals based upon the range, bearing, magnitude and rate of change in range information, said control signals including a variable thrust signal whose magnitude is dependent on the direction, magnitude and rate of change in range;

said controller performing mathematical transformations upon the position information signals which are based upon the horizontal distance of said antenna from said thruster or another point of interest on or near the boat to produce a new position information signal being that of said thruster or other point of interest for use in providing the control signals;

a wireless manually actuated remote interface for transmitting control signals to said controller and for receiving audible responses relative to action taken by said controller.

22. A system as set forth in claim 21, wherein:

said controller is programmed to selectively operate said system in an anchor mode, a trolling mode or a manual mode.

23. A system as set forth in claim 21, wherein:

the magnitude of said thrust signal is modulated to dampen the velocity of the boat as a desired position is approached based upon the range rate as modified by the yaw rate of the boat.

24. A system as set forth in claim 21, wherein:

the magnitude of said thrust signal is also based upon a long term average range error taken over an extended time period of at least about five seconds and is expressed substantially as:

$$\text{thrust}=[K1*\text{range}]-[K2*\text{range rate}]+[K3\ \text{average range error}]$$

wherein K1, K2 and K3 are independently adjustable constants and range rate equals the velocity toward (+) or away from (−) a selected location.

25. A system as set forth in claim 21, further comprising:

a non-steerable rear thruster positioned at the stern of the boat, said rear thruster producing a variable lateral or athwartship thrust responsive to a separate control signal from said controller.

26. A system as set forth in claim 21, wherein:

said system is programmed by said remote interface to operate in a trolling mode, said controller establishing a straight course in a desired direction along a track line and then providing control signals to said thruster to move the boat along the track line without substantial variance therefrom.

27. A system as set forth in claim 21, wherein:

said controller is programmable to receive and store multiple selected anchor locations each of which may be established by said remote interface as a desired position to which the boat will be propelled by said thruster.

28. A system for substantially controlling the position of a boat in water as selected by an operator of the boat, the system comprising:

a thruster attached in proximity to the boat, said thruster rotatable about an upright shaft axis and driven by a power source for moving the boat to a selected location within the water;

a DGPS or WAAS-enabled receiver and antenna located onboard the boat for receiving signals from GPS satellites and differential correction signals from another source, said receiver providing position information signals indicative of the position of said antenna in a differential GPS mode of operation based on said signals from the GPS satellites and the differential correction signal source;

an electronic compass for providing current heading indication signals representative of the heading of the boat;

a controller receiving input signals from said receiver, said compass and a feedback thruster steering signal equal to the relative angle between the heading of the boat and that of said thruster, said controller calculating range, bearing, magnitude and rate of change in range information based upon the difference between the selected position and present position of said antenna, said controller providing control signals to said thruster for steering and propelling the boat to a selected anchoring position, the control signals being related to calculated range, bearing, magnitude and rate of change in range computations, said control signals including a variable thrust signal whose magnitude is dependent on the direction, magnitude and rate of change in range;

a wireless manually actuated remote interface for transmitting control signals to said controller;

said controller programmed to selectively operate said system in an anchor mode, a trolling mode or a manual mode;

the magnitude of said thrust signal is modulated to dampen the velocity of the boat as a desired position is approached based upon the range rate as modified by the yaw rate of the boat.

29. A system as set forth in claim 28, wherein:

the magnitude of said thrust signal is also based upon a long term average range error taken over an extended time period of at least about five seconds and is expressed substantially as:

$$\text{thrust}=[K1*\text{range}]-[K2*\text{range rate}]+[K3*\text{average range error}]$$

wherein K1, K2 and K3 are independently adjustable constants and range rate equals the velocity toward (+) or away from (−) a selected location.

30. A system as set forth in claim 28, further comprising:

a non-steerable rear thruster positioned at the stern of the boat, said rear thruster producing a variable lateral or athwartship thrust responsive to a separate control signal from said controller.

31. A system as set forth in claim 28, wherein:

said system is programmed by said remote interface to operate in a trolling mode, said controller establishing a straight course in a desired direction along a track line and then providing control signals to said thruster to move the boat along the track line without substantial variance therefrom.

32. A system as set forth in claim 28, wherein:

said controller is programmable to receive and store multiple selected anchor locations each of which may be established by said remote interface as a desired position to which the boat will be propelled by said thruster.

33. A system for establishing and maintaining a position of a boat in water as selected by an operator of the boat, the system comprising:

two spaced apart thrusters each attached to the boat, each said thruster independently driven by a power source for moving the boat to a first selected geographic location within the water;

a DGPS or WAAS-enabled receiver and antenna located onboard the boat and being spaced apart horizontally from said thrusters for receiving signals from GPS satellites and differential correction signals from another source, said receiver providing position information signals indicative of the position of said antenna in a differential GPS mode of operation based on said signals from the GPS satellites and the differential correction signal source;

an electronic compass for providing current heading indication signals representative of the true heading of the boat;

a controller receiving input signals from said receiver and said compass;

said controller modifying the position information signals by performing a mathematical transformation thereon based upon the distance of said antenna from another point of interest on or near the boat to produce a second position information signal being that of the other point of interest for use in providing the control signals;

said controller providing control signals to each said thruster for producing a net steering thrust vector which steers and propels the boat to position the antenna at the first selected geographic location, for maintaining a selected orientation of the longitudinal axis of the boat and to also position the other point of interest at the second selected geographic location, the control signals based upon the range, bearing, magnitude and rate of change in range information, said control signals including a variable thrust signal whose magnitude is dependent on the direction, magnitude and rate of change in range;

a wireless manually actuated remote interface for transmitting control signals to said controller, said controller providing audible responses to advise an operator as to actions taken by said controller.

34. A system as set forth in claim 33, wherein:

said thrusters are non-rotatable about an upright axis thereof.

35. A system as set forth in claim 34, wherein:

each of said thrusters is oriented to produce only either a forward or rearward thrust generally in alignment with the length of the boat.

36. A system as set forth in claim 34, wherein:

one said thruster is positioned at or in close proximity to the bow of the boat and produces only a forward or a rearward thrust generally in alignment with the length of the boat;

another said thruster is positioned at or in close proximity to the stern of the boat and produces only a lateral or athwartship thrust with respect to the boat.

37. A system as set forth in claim 33, wherein:

one said thruster is positioned at or in close proximity to the bow of the boat and is rotatable about an upright axis thereof;

another said thruster is positioned at or in close proximity to the stern of the boat and produces only a lateral or athwartship thrust with respect to the boat.

38. A system for substantially controlling the geographic position of the bow, or other part of a boat in water at a location selected by an operator of the boat thus virtually anchoring the boat, the system comprising:

a thruster means located in proximity to the bow, or point of interest, of the boat, said thruster capable of producing a steerable thrust force to move that part of the boat to the selected location, or virtual anchoring point, within the water;

a DGPS or WAAS enabled receiver and antenna located onboard the boat for receiving signals from differential correction sources and GPS satellites, said receiver providing information as to the geographical position of said antenna, said antenna being located at a second point of interest on the boat;

an electronic means for providing information representative of the heading of the boat;

a controller receiving the information signals from said GPS receiver, said compass and said thrust direction relative to the heading of the boat, said thruster providing output signals to said thruster to control the direction and magnitude of the thrust, these output signals being computed as based on the calculated range and bearing to the desired anchoring site and upon the rate of change of range to the anchoring site;

a wireless manually activated remote control interface with which the operator of said boat can issue commands to said controller to control its mode of operation;

whereby the system can be commanded to operate in a trolling mode, said controller calculating a straight course in a desired direction and continually calculating a new anchoring site along that course or track such that the bow of the boat is forced to continuously follow that track with little or no cross-track error and wherein said remote control can be used to issue commands to increase or decrease the apparent trolling speed of the boat by having the controller displace the continuous moving anchor site an appropriate distance each computation cycle;

one of point of interest on the boat is substantially maintained at a constant geographic location and the orientation, or heading of the boat, is also maintained at a constant angle, a second thruster means for providing a yaw thrust force to rotate the boat about its center of gravity in azimuth;

said controller also issuing output signals to the second thruster means as required to maintain a constant boat heading thus controlling the orientation of the boat.

39. A system for substantially controlling the geographic position of the bow, or other part of a boat in water at a location selected by an operator of the boat thus virtually anchoring the boat, the system comprising:

a thruster means located in proximity to the bow, or point of interest, of the boat, said thruster capable of producing a steerable thrust force to move that part of the boat to the selected location, or virtual anchoring point, within the water;

a DGPS or WAAS enabled receiver and antenna located onboard the boat for receiving signals from differential correction sources and GPS satellites, said receiver providing information as to the geographical position of said antenna, said antenna being located at a second point of interest on the boat;

an electronic means for providing information representative of the heading of the boat;

a controller receiving the information signals from said GPS receiver, said compass and said thrust direction relative to the heading of the boat, said thruster providing output signals to said thruster to control the direction and magnitude of the thrust, these output signals being computed as based on the calculated range and bearing to the desired anchoring site and upon the rate of change of range to the anchoring site;

a wireless manually activated remote control interface with which the operator of said boat can issue commands to said controller to control its mode of operation;

whereby the system can be commanded to operate in a trolling mode, said controller calculating a straight course in a desired direction and continually calculating a new anchoring site along that course or track such that the bow of the boat is forced to continuously follow that track with little or no cross-track error and wherein said remote control can be used to issue commands to increase or decrease the apparent trolling speed of the boat by having the controller displace the continuous moving anchor site an appropriate distance each computation cycle;

said controller modulating the magnitude of the thrust as a function of the bearing angle from the bow to the anchoring site and the thrust output signal is expressed substantially as:

$$\text{thrust}=[[K1*\text{range}]-[K2*\text{range rate}]+[K3*\text{average range}]]*[1-K4*\text{Sine(bearing to site)}]$$

wherein k1, K2, K3 and K4 are independently software adjustable constants and range rate is defined as being positive when range is decreasing and negative when range is increasing.

* * * * *